US006464529B1

(12) United States Patent
Jensen et al.

(10) Patent No.: US 6,464,529 B1
(45) Date of Patent: Oct. 15, 2002

(54) CONNECTOR ELEMENT FOR HIGH-SPEED DATA COMMUNICATIONS

(75) Inventors: Morten Petri Jensen, Sorring; Ulrik Nielsen, Silkeborg, both of (DK)

(73) Assignee: Cekan/CDT A/S (DK)

( * ) Notice: Subject to any disclaimer, the term of this patent is extended or adjusted under 35 U.S.C. 154(b) by 0 days.

(21) Appl. No.: 09/553,728

(22) Filed: Apr. 20, 2000

Related U.S. Application Data

(63) Continuation-in-part of application No. 09/188,984, filed on Nov. 9, 1998, now Pat. No. 6,102,730, which is a continuation-in-part of application No. 08/530,266, filed as application No. PCT/DK94/00107 on Mar. 11, 1994, now Pat. No. 6,113,418.

(30) Foreign Application Priority Data

Mar. 12, 1993 (DK) ..... 0281/93

(51) Int. Cl.[7] ..... H01R 4/24
(52) U.S. Cl. ..... 439/405; 439/941; 439/676
(58) Field of Search ..... 439/941, 676, 439/405

(56) References Cited

U.S. PATENT DOCUMENTS

| | | | | | |
|---|---|---|---|---|---|
| 4,418,239 | A | | 11/1983 | Larson et al. | 174/34 |
| 4,744,772 | A | | 5/1988 | Reichardt et al. | 439/405 |
| 4,756,695 | A | | 7/1988 | Lane et al. | 439/76 |
| 4,917,629 | A | | 4/1990 | Matsuzaki et al. | 439/405 |
| 4,986,779 | A | | 1/1991 | Ferrill et al. | 439/108 |
| 5,064,383 | A | | 11/1991 | Locati et al. | 439/405 |
| 5,186,647 | A | | 2/1993 | Denkmann et al. | 439/395 |
| 5,226,835 | A | * | 7/1993 | Baker, III et al. | 439/941 |
| 5,326,286 | A | | 7/1994 | Bixler et al. | 439/751 |
| 5,399,107 | A | * | 3/1995 | Gentry et al. | 439/941 |
| 5,513,065 | A | * | 4/1996 | Caveney et al. | 439/941 |
| 5,586,914 | A | | 12/1996 | Foster, Jr. et al. | 439/676 |
| 5,921,818 | A | | 7/1999 | Robert et al. | |
| 6,017,229 | A | | 1/2000 | Art et al. | |

FOREIGN PATENT DOCUMENTS

| | | |
|---|---|---|
| EP | 0782221 A | 7/1977 |
| EP | 0 456 340 A2 | 11/1991 |
| EP | 0993082 A | 4/2000 |
| WO | WO 93/1950 | 9/1993 |

* cited by examiner

*Primary Examiner*—Tho D. Ta
(74) *Attorney, Agent, or Firm*—Wolf Greenfield & Sacks P C

(57) ABSTRACT

A connector element for making a connection between electrical conductors in a network. The connector element has a front, a rear and a length between the front and the rear. The connector element includes a plurality of contact terminals arranged in at least one plane at the front of the connector element. The plurality of contact terminals are configured for connection with corresponding contact terminals of a mating connector element. The connector element includes a plurality of wire connector terminals arranged in first and second rows at substantially the rear of the connector element. The connector element also includes a plurality of leads, wherein each lead connects a corresponding wire connector terminal with a corresponding contact terminal. The plurality of leads include a plurality of layers of leads. The shape and arrangement of the plurality of layers of leads make up a compensation structure that optimizes the electrical performance of the connector including the connector element and the mating connector element.

100 Claims, 15 Drawing Sheets

CONNECTOR ELEMENT FOR HIGH-SPEED DATA COMMUNICATIONS

This application claims priority under 35 U.S.C. §120, to and is a continuation-in-part of U.S. patent application Ser. No. 09/188,984, filed Nov. 9, 1998, U.S. Pat. No. 6,102,730 and which is herein incorporated by reference, which is a continuation-in-part of U.S. patent application Ser. No. 08/530,266, filed Sep. 1, 1995 U.S. Pat. No. 6,113,418, which entered the U.S as a national stage application under 35 U.S.C. §371 from an International Application No. PCT/DK94/00107 having an international filing date of Mar. 11, 1994, and having a priority date of Mar. 12, 1993 based on Denmark Application 0281/93.

BACKGROUND

1. Field of the Invention

The present invention is in the field of cable and connector components for high-speed data communications. In particular, the invention is in the field of cable and connector components in which undesired reactances and crosstalk are compensated for.

2. Description of the Related Art

The deployment of new computer network architectures has increased the demand for improved data communication cables and connectors. Conventional cables and connectors have been used for voice transmission and for low-speed data transmission in the range of a few megabits per second. However, because conventional data cables and connectors were inadequate for high-speed, bit-error-free data transmission within current or proposed network architectures, new types of high-speed data communication cables and connectors have been developed. Such new cables or connectors need to meet specific requirements such as low attenuation, acceptable return loss, low crosstalk and good EMC (Electro-Magnetic Coupling) performance parameters. They also need to meet specific requirements with respect to impedance, delay, delay skew and balance.

Cables for transmitting high-speed digital signals frequently make use of twisted pair technology, because twisted pairs of conductors eliminate some types of crosstalk and other noise. Crosstalk is a measure of undesirable signal coupling from one signal carrying medium to another. In a twisted pair, each conductor of the twisted pair carries an information signal that is equal in amplitude and 180° out of phase with the counter-part signal carried by the pair. That is, each twisted pair carries differential signals. Ideally, the proximity of the twisted pairs to each other causes crosstalk to affect both conductors of the twisted pair equally. Thus, this noise ideally occurs in both conductors of the twisted pair creating a common mode signal. Crosstalk coupled to the same pair within the same cable can be compensated by adaptive amplifier techniques that substantially reject common mode signals. However, differential noise, which is noise that does not occur equally in both conductors of a twisted pair, cannot be compensated for with such techniques.

Several different measures of crosstalk have been developed to address concerns arising in different cables, communications systems and environments. One useful measure of crosstalk is near-end crosstalk (NEXT). Near-end crosstalk is a measure of the signal coupled between two media, e.g., two twisted pairs of conductors, within a cable. A signal is injected into one end of the first medium and the coupled signal is measured at the same end of the second medium. Another useful measure of crosstalk is far-end crosstalk (FEXT). Like NEXT, FEXT is a measure of the signal coupled between two media within a cable. A signal is injected into one end of the first medium and the coupled signal is measured at the other end of the second medium. Other measures of crosstalk exist, including measures for crosstalk of other types. For example, there is so-called alien crosstalk, which is coupling into a cable from outside of a cable, such as from another cable, which may also be of interest.

A connector usually includes a plug that is mated with a jack that has a receptacle-type opening for mating with the plug. The plug and jack usually include a housing having a wire-receiving end, a contact-terminating end, a passageway for communicating internally between the respective ends of the plug, and a plurality of leads that couple contact terminals at the contact-terminating end of the plug to wire connector terminals at the wire-receiving end of the plug.

Modern data networks typically have connector systems including data transmission cables built into the walls of a building, which are terminated by a connector jack to enable flexible use of space. Individual computers are typically connected to the data network using a patch cord cable assembly terminated with a connector plug, by inserting the connector plug into the connector jack. A patch cord cable assembly typically includes a data transmission cable, typically with four twisted pairs of conductors, and two plugs. The four twisted pairs may be wrapped either in a flat or a round insulating jacket. The jacket may optionally include a drain wire and a surrounding shield for use with a shielded plug. A goal with such a patch cord is typically to minimize EMC and EMI (Electro-Magnetic Interference) to the outside environment as required by various regulations.

Many such related art connector systems have been used to transmit low-frequency data signals, and have exhibited no significant crosstalk problem between conductors of different twisted pairs at low frequencies. However, when such connector systems are used for transmission of high-frequency data signals, crosstalk between different twisted pairs increases dramatically. For such connector systems, this problem typically is caused by the construction of the connectors, wherein the leads within the connector are substantially parallel and in close proximity to each other, thereby producing excessive crosstalk between them.

It is common practice in such connector systems, according to a pre-established standard for connectors (and in particular the connector contact terminals), to configure each of the plug and jack with rows of the contact terminals which are connected with corresponding rows of the wire connector terminals, through the parallel leads in the connector element. However, there is a certain capacitive coupling that exists between the parallel leads of such a connector element. In addition, since it is a desire that the connector be as small as possible, this accentuates the capacitive coupling problem because the required small dimensions result in a small distance between the leads of the connector element, and thus a relatively high capacitance between the leads. In addition, while the capacitance between adjacent leads of a connector element may be relatively high, the capacitance may also be undesirably low between non-adjacent leads of the connector element. For example, it may be desirable to have a higher capacitance between non-adjacent leads to provide compensation for capacitance introduced elsewhere.

Also, problems occur not only with the capacitance between the leads of the connector element, but also with respect to the mutual inductance between the leads and, in particular, between pairs of the leads, as well as the inductance of the leads themselves, which is a function of the width of the leads. The mutual inductance between the pairs of leads is a function of a coil effect between the pairs of the leads. Thus, the pre-established standard for the contact terminals and the size of the connector do not create ideal conditions in the connector element.

A number of popular modular, multi-conductor connectors have been used in telecommunications applications and data transmission applications. Such connectors include 4-conductor, 6-conductor and 8-conductor types, commonly referred to as RJ-22, RJ-11, and RJ-45 connectors. Referring to FIG. 1, there is illustrated as in known in the related art an 8-conductor RJ-45-type connector 5, which includes a jack 30 and a plug 10. Each is typically made from a plastic body surrounding and supporting eight leads (not illustrated). Specifically, the RJ-45-type plug 10 has eight leads located side-by-side. Each lead is connected to a wire connecting portion at one end of the plug, and a contact terminal at a second end of the plug. The RJ-45-type jack 30 also has eight conductive leads (not illustrated) typically located side-by-side, and each lead also is connected to a wire connecting terminal at a first end of the jack and to a contact terminal arranged as a cantilever spring, at a second end of the jack. Typically, each of the eight wire connector terminals of the plug are connected to a corresponding conductor of the four twisted pairs of conductors of the patch cord cable, in a standard arrangement.

As mentioned above, the related art RJ-45 plug and jack typically have the leads placed straight in parallel and in close proximity to each other. The close proximity increases the parasitic capacitance between the leads, and the straight parallel arrangement increases the mutual inductance between the leads. These parasitic capacitances and mutual inductances are a principal source of differential noise, due to coupling. Specifically, crosstalk occurs between the electric field of one lead and the electric field of an adjacent lead within the jack or plug. The crosstalk coupling is inversely proportional to the distance between the interfering leads. The signal emitted from one emitting lead may be capacitively and/or inductively coupled to a another lead that is connected to a first conductor of a twisted pair of conductors. However, since a lead connected to a second conductor of the twisted pair of conductors is at a different distance from the emitting lead, this creates a differential coupling in the twisted pair of conductors.

There has also been in the interest of both manufacturers and end users, standardization of equipment and quantification of the emission parameters, including attenuation, near-end crosstalk and return loss for unshielded twisted pair (UTP) connectors. For example, the Electronic Industry Association (EIA) Telecommunication Industry Association (TIA), in an attempt to reach cross-manufacturer compatibility, set EIA/TIA-568-A which mandates a maximum coupling level in, for example, a category 5 plug and connector. The connectors of the related art have included counter-coupling or compensation structures designed to minimize the overall coupling inside the connectors. However, in the connectors of the related art, the effectiveness of this counter-coupling compensation has been limited, for example, because there is a variability in the different plugs' crosstalk coupling.

Accordingly, there is a need for an improved connector including an improved jack and/or an improved plug that can provide improved crosstalk performance of the entire connector.

SUMMARY OF THE INVENTION

It is to be understood that according to this specification, a connector is a device that connects a transmission medium such as, for example, a communications cable to another communications device such as, for example, a personal computer or to another communication medium. It is also to be understood that according to this specification, a connector is made up of mating connector elements typically referred to as a plug and a jack, and therefore it is to be understood that a connector element according to this specification can be either a plug or a jack of a connector.

According to the invention, one connector element for making a connection between electrical conductors in a communications network has a front, a rear and a length between the front and the rear. The connector element includes a plurality of contact terminals arranged at the front of the connector element and that are configured for connection with corresponding contact terminals of a mating connector element. The connector elements also includes a plurality of wire connector terminals arranged at substantially the rear of the connector element. The connector element further includes a plurality of leads, each lead connecting a corresponding wire connector terminal with a corresponding contact terminal, wherein the plurality of leads include three layers of leads that in combination provide a compensation structure that reduces noise or crosstalk introduced by a combination of the connector element and the mating connector element.

According to the invention, another connector element for making a connection between electrical conductors in a communications network has a front, a rear and a length between the front and the rear. The connector element includes a plurality of contact terminals arranged at the front of the connector element and that are configured for connection with corresponding contact terminals of a mating connector element. The connector elements also includes a plurality of wire connector terminals arranged at substantially the rear of the connector element. The connector element further includes a plurality of leads, each lead connecting a corresponding wire connector terminal with a corresponding contact terminal. The plurality of leads are fixed in a permanent relationship so as to fix the electrical performance of the connector element, by an integrally formed housing enclosing at least a portion of the plurality of leads, that holds the plurality of leads in the fixed relationship.

According to the invention, another connector element for making a connection between electrical conductors in a communications network has a front, a rear and a length between the front and the rear. The connector element includes a plurality of contact terminals arranged at the front of the connector element and that are configured for connection with corresponding contact terminals of a mating connector element. The connector element also includes a plurality of wire connector terminals arranged at substantially the rear of the connector element. The connector element further includes a plurality of leads, each lead connecting a corresponding wire connector terminal with a corresponding contact terminal. The plurality of leads include means for sequentially compensating for noise or crosstalk introduced by a combination of the connector element and the mating connector element.

According to the invention, another connector element for making a connection between electrical conductors in a communications network has a front, a rear and a length between the front and the rear. The connector element includes a plurality of contact terminals arranged at the front of the connector element and that are configured for connection with corresponding contact terminals of a mating connector element. The connector element also includes a plurality of wire connector terminals arranged at substantially the rear of the connector element. The connector element further includes a plurality of leads, each lead connecting a corresponding wire connector terminal with a corresponding contact terminal. A lead of a pair of leads of the plurality of leads includes in series, a first capacitive plate and a second capacitive plate, wherein the first capacitive plate and the second capacitive plate in combination with corresponding capacitive plates of another pair of leads, form first and second capacitors. The lead in combination with a lead of the other pair of leads also form an inductive loop. The first capacitor, the inductive loop and the second capacitor in combination compensate for noise or crosstalk introduced by a combination of the connector element and the mating connector element.

According to the invention, another connector element for making a connection between electrical conductors in a communications network has a front, a rear and a length between the front and the rear. The connector element includes a plurality of contact terminals arranged at the front of the connector element and that are configured for connection with corresponding contact terminals of a mating connector element. The connector element also includes a plurality of wire connector terminals arranged at substantially the rear of the connector element. The connector element further includes a plurality of leads, each lead connecting a corresponding wire connector terminal with a corresponding contact terminal. The plurality of leads include a plurality of layers of leads that in combination provide a compensation structure that reduces noise or crosstalk introduced by a combination of the connector element and the mating connector element. In addition, at least two of the plurality of wire connector terminals include means for providing a capacitance between the at least two wire connector terminals.

According to the invention, another connector element for making a connection between electrical conductors in a communications network has a front, a rear and a length between the front and the rear. The connector element includes a plurality of contact terminals arranged at the front of the connector element and that are configured for connection with corresponding contact terminals of a mating connector element. The connector elements also includes a plurality of wire connector terminals arranged at substantially the rear of the connector element. The connector element further includes a plurality of leads, each lead connecting a corresponding wire connector terminal with a corresponding contact terminal. The plurality of leads include a plurality of layers of leads that in combination provide a compensation structure that reduces noise or crosstalk introduced by a combination of the connector element and the mating connector element. In addition, at least two of the wire connector terminals include enlarged portions of the wire connector terminals that narrow a spacing between the at least two wire connector terminals and that provide a parallel plate capacitance between adjacent edges of the at least two wire connector terminals.

BRIEF DESCRIPTION OF THE DRAWINGS

It is to be understood that drawings are for the purpose of illustration only and they are not intended as a definition of the limits of the invention. The foregoing and other objects and advantages of the invention will be more fully appreciated from the following detailed description when taken in conjunction with the following drawings in which.

DETAILED DESCRIPTION

It is to be understood that according to this specification, a connector is a device that connects a transmission medium to another transmission medium or to a communications device. The transmission medium can be of any type (e.g., cable), and the invention is not limited. Similarly, a communications device can be of any type (e.g., a personal computer), and the invention is not limited. For example, a connector can connect a communications cable to a personal computer. According to this specification a connector is made up of mating connector elements typically referred to as a plug and a jack, and therefore it is to be understood that a connector element according to this specification can be either a plug or a jack of a connector.

According to one embodiment of the invention, there is provided an improved connector element having improved electrical performance. As will be described in detail infra, there is provided at least one embodiment of a connector element having a novel arrangement of its leads and a lead frame. In particular, according to one embodiment of the invention, there is provided a connector element having its leads shaped and arranged so as to offset and thus electrically balance out coupling introduced by the mating connector element, so that the overall connector comprising the connector element and the mating connector element has reduced crosstalk between the leads of the connector, so that when the connector element is connected with the mating connector element, the connector has an optimized electrical performance. As will be discussed infra, in one embodiment the reduced crosstalk between the leads of the connector can be the result of any of an optimized capacitance between the leads of the connector, an optimized mutual inductance between the leads of the connector element, an optimized inductance of the leads of the connector, and a combination of any of these. In addition, as will be discussed infra, in one embodiment, the performance of the connector is fixed and made repeatable by integrally molding the leads of the connector within a housing, wherein the leads of one connector element are shaped and arranged to provide the desired reactances so as to offset coupling introduced by the mating connector element.

Figure 1:
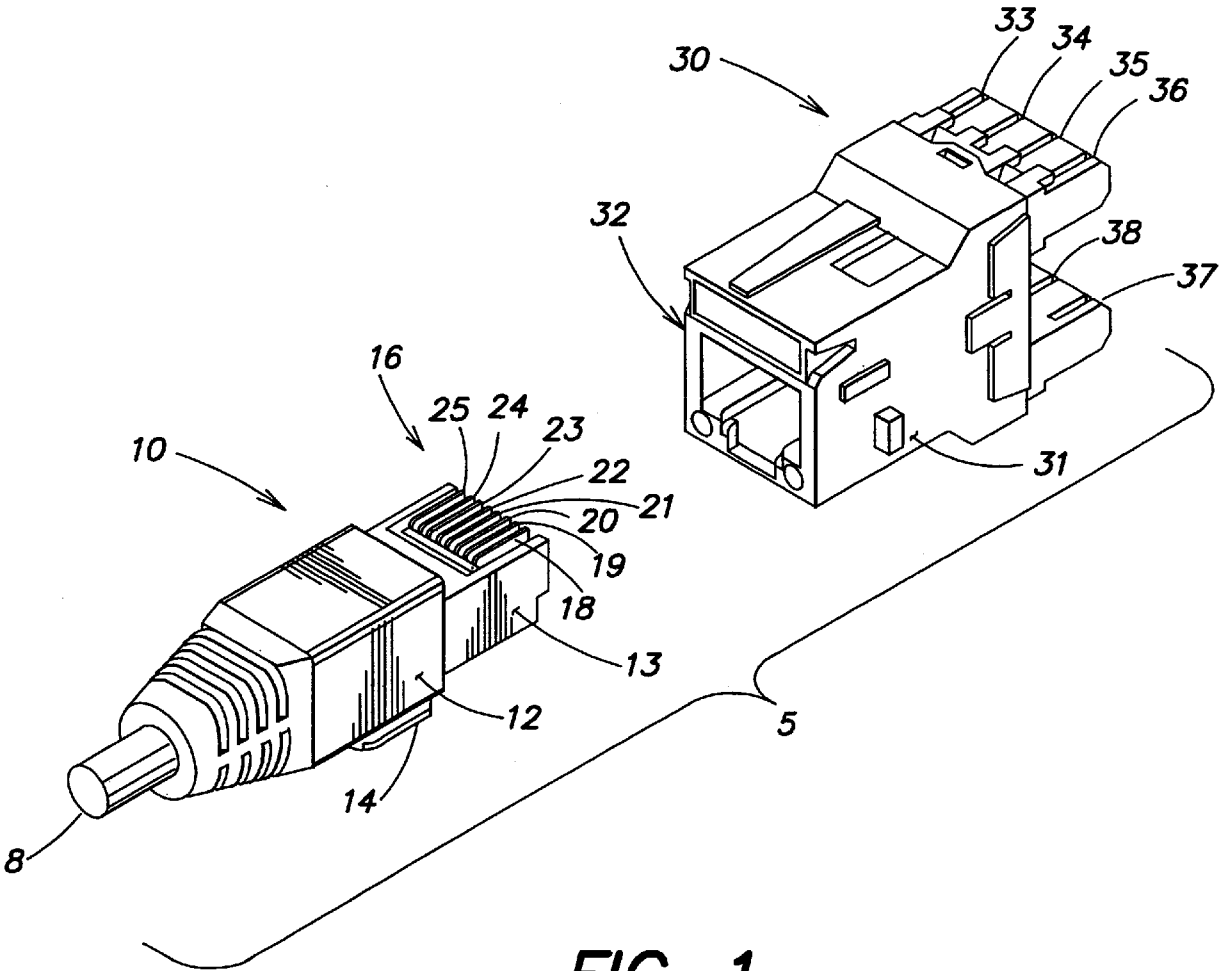
FIG. 1 (RELATED ART)
FIG. 1 illustrates a perspective view of a conventional RJ-type connector including an RJ-type plug and an RJ-type jack.

Referring to FIG. 1, FIG. 1 illustrates an RJ-type connector 5, as is known in the related art, which includes an RJ-type plug 10 and an RJ-type jack 30. As will be discussed infra, according to one embodiment of the invention, either one or both of the plug and jack can be replaced by an embodiment of a connector element of the invention. Plug 10 typically includes an isolating shell 12, partially surrounding a body 13, and has a snap detent mechanism 14 for mating with jack 30. Plug 10 includes eight contact terminals 18, 19, 20, 21, 22, 23, 24 and 25 that are located in separate slots formed in the body 13 at region 16 of the plug. Contact terminals 18–25 may be directly connected to eight wire connector terminals (not illustrated) through the body 13 as is done in known connectors, or may be connected via a compensation structure according to one embodiment of the invention, to be described in detail infra. The wire connector terminals are typically connected to four twisted pairs of conductors of a data transmission cable 8, with one wire connector terminal mating with one insulated conductor.

As a result, the contact terminals 18–25 are electrically connected to eight insulated conductors arranged in four twisted pairs and located in the data transmission cable. Each wire connector terminal may be an insulation displacement wire connector terminal, to be discussed in further detail infra, which has sharp points for cutting through the insulation of the conductors, to contact the metal wire of the conductor, as is known in the art.

Jack 30 includes a jack housing 31 surrounding eight leads that connect eight contact terminals (not shown) in region 32 of the jack to eight wire connector terminals 33, 34, 35, 36, 37, 38, 39 and 40 (wire connector terminals 39 and 40 are not illustrated in FIG. 1). When plug 10 is inserted into jack 30, the contact terminals 18–25 individually contact the corresponding contact terminals of the jack 30, and thus make an electrical connection.

As discussed supra, with known RJ-45 connectors, the parallel, side-by-side leads within, for example, the plug 10 cause crosstalk by their capacitive and inductive coupling. To reduce this crosstalk, according to one embodiment of the invention, plug 10 or the jack 30 may include a compensation structure designed to counter-couple and thus electrically balance the frequency dependent capacitive and inductive coupling introduced by a combination of the connector element and the mating connector element. In addition, according to another embodiment of the invention, a compensation structure within one connector element may be provided to introduce capacitive or inductive coupling that is known and that can be balanced by another compensation structure within the mating connector element. Accordingly, it is to be appreciated that an overall advantage of the connector of the invention is that it minimizes crosstalk and thereby reduces data transmission errors caused by parasitic effects between leads of the connector elements, especially at high frequencies (e.g. greater than 100 MHz). It is also to be appreciated that, although there will be described one embodiment of a compensation structure of the invention in connection with an 8-conductor connector system designed for high-frequency data transmission (an RJ-45-type connector), the compensation structure of the invention can be used with any type of connector and is so intended.

Figure 2:
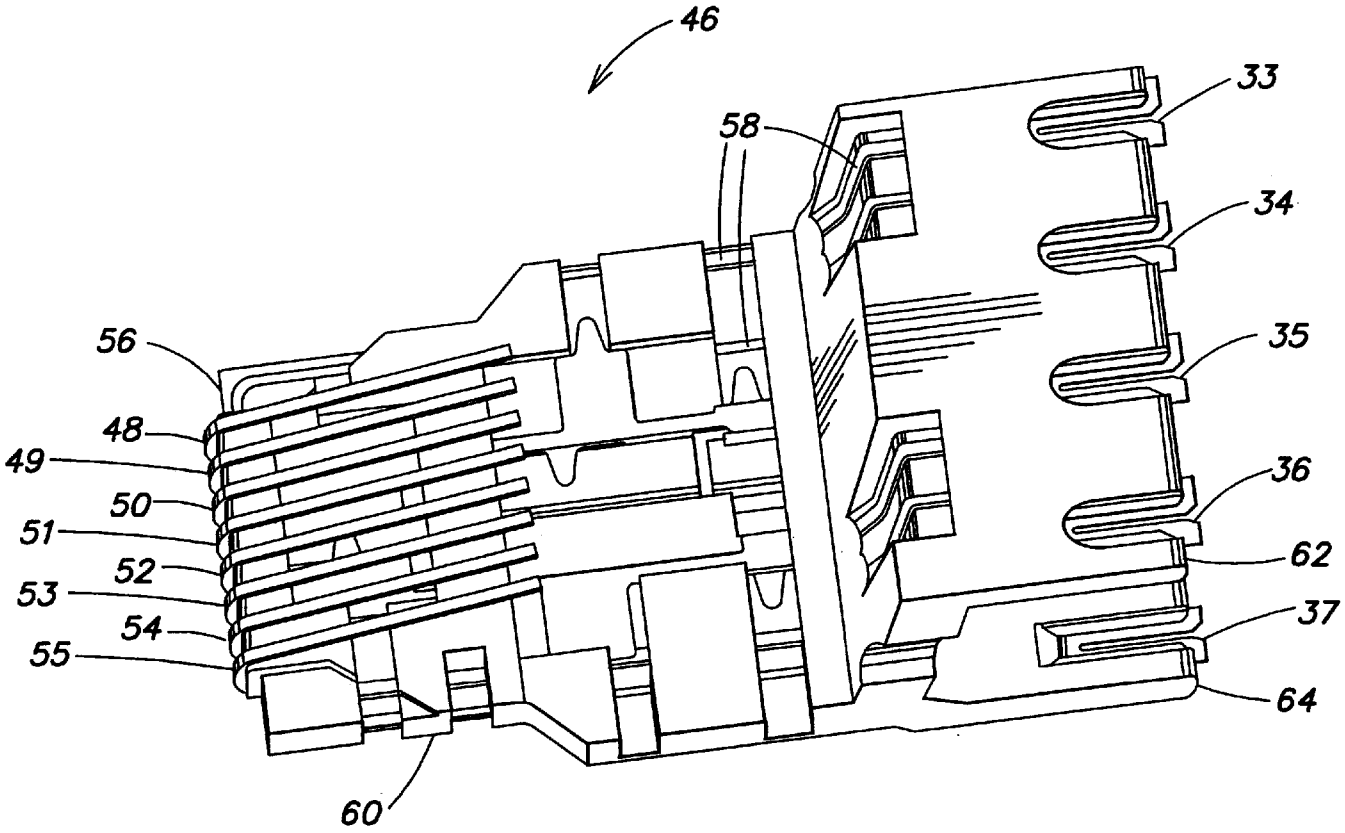
FIG. 2 illustrates a perspective view of a lead frame of a connector element of one embodiment of the invention.

Referring now to FIG. 2, there is illustrated a perspective view of a lead frame 46 of one embodiment of the invention. In this embodiment, the lead frame is part of the jack assembly of the connector. The lead frame includes eight contact terminals 48, 49, 50, 51, 52, 53, 54 and 55 protruding from a front end 56 of the lead frame, that are configured into a cantilever spring arrangement as illustrated in FIG. 2. It is to be appreciated that although in this embodiment the contact terminals are configured into a cantilever spring arrangement, that other arrangements for the contact terminals are possible and are intended to be included within the invention. It is also to be appreciated that although this embodiment of the lead frame is illustrated with eight contact terminals, eight leads, and eight wire connector terminals to accommodate eight conductors, a connector element having an embodiment of the compensation structure of the invention can accommodate any number of conductors including, for example, four or six conductors, which are known as respective RJ-22 and RJ-11-type connectors.

The lead frame illustrated in FIG. 2 includes leads 58 (some, not all, of the leads are indicated by reference number 58) that are disposed within an intricately formed plastic molding 60. The contact terminals are connected via respective leads 58 to corresponding wire connector terminals 33–40 (wire connector terminals 38–40 are not illustrated in FIG. 2). In this embodiment, the wire connector terminals are arranged in two rows 62, 64, with four wire connector terminals in each row. However, it is to be appreciated that any number of rows are possible and that the wire connector terminals need not be arranged in rows. Each of the wire connector terminals illustrated is a U-shaped insulation displacement terminal, which is provided with a notch for receiving an insulated conductor and which has sharp edges for cutting through the insulation of the insulated conductor to contact the metal wire of the conductor. However, it is to be appreciated that the wire connector terminals are not limited to this shape and type of terminal, and that other wire connector terminal types and shapes are intended to be within the scope of the invention.

Figure 3:
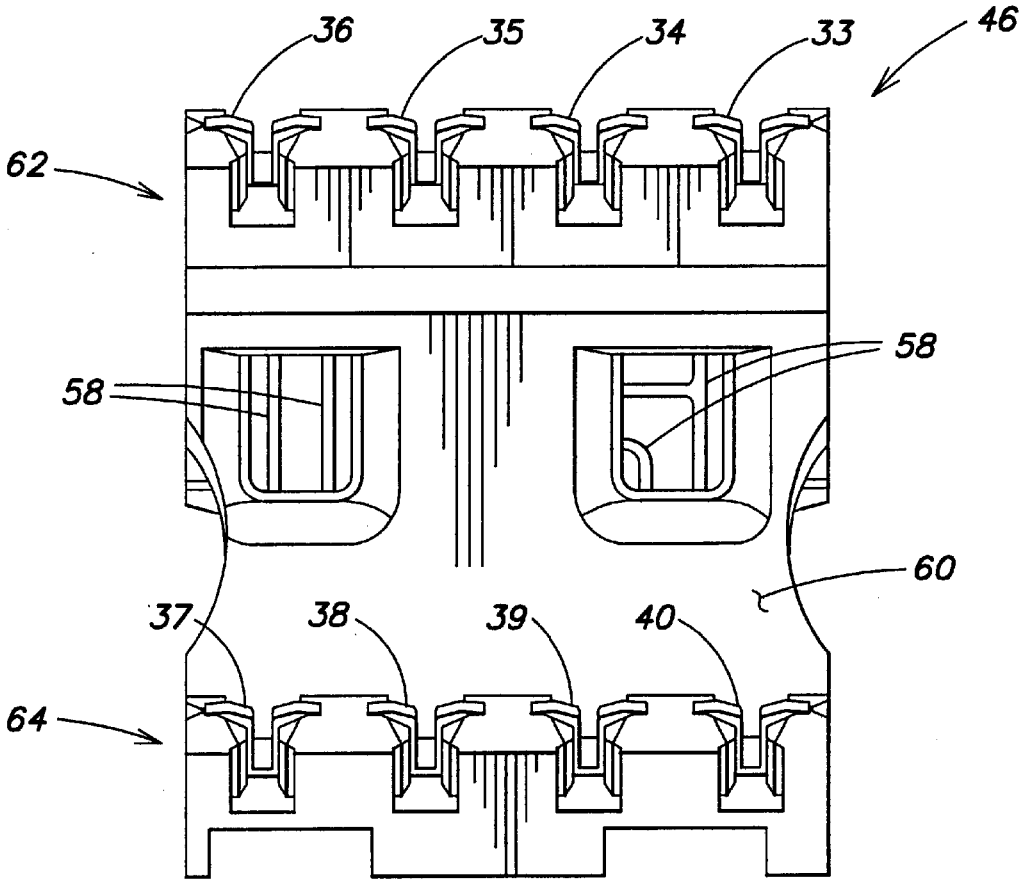
FIG. 3 illustrates a rear elevational view of the lead frame assembly of FIG. 2.

FIG. 3 illustrates a rear elevational view of the lead frame assembly 46 and illustrates the first row 62 of wire connector terminals 33–36 and the second row 64 of wire connector terminals 37–40. FIG. 3 also illustrates some additional plurality of leads 58 that are disposed within the intricately formed plastic molding 60.

The lead frame assembly of this embodiment of the invention shown in FIGS. 2–3, includes a compensation structure to be discussed in further detail infra, which can be used in either the plug assembly 10 or the jack assembly 30 (See FIG. 1). The leads 58 of the lead frame assembly are shaped and arranged so as to specifically introduce a known and preferred amount of capacitance and inductance between the leads to compensate for the noise and/or crosstalk introduced by the mating connector element. In particular, the amount of capacitance and inductance provided by the shape and arrangement of the leads is selected to countercouple and electrically balance out the capacitance and inductance introduced by the combination of the contact terminals, leads and wire connector terminals of the connector element and the mating connector element. In this manner, the compensation structure of the invention reduces the overall crosstalk and noise of the connector system 5 (see FIG. 1) and thus optimizes the data transmission performance of the connector system.

Referring again to FIG. 1, the data transmission cable 8 includes, for example, four twisted pairs of insulated conductors. In the body of cable 8, each conductor of a twisted pair of conductors is affected substantially equally by adjacent conductors because the twisted conductor pairs are twisted together along the length of the cable, as is known in the art. However, when the cable 8 terminates at either plug 10 or jack 30, the twisted pairs are untwisted and flattened out so that the conductors can mate with the corresponding wire connector terminals of the plug or jack, resulting in several conductors forming a substantially linear arrangement. In particular, a variable amount of deformation of the individual conductors is required to align the conductors to mate with the wire connector terminals of the plug or the jack. This deformation can be controlled, for example, by a strain relief device such as disclosed in International Application Number PCT/DK99/00230 filed on Apr. 23, 1999 and claiming priority to Application DK 0568/98 filed on Apr. 24, 1998, herein incorporated by reference. With the strain relief device as provided, there can be provided a well-controlled electrical separation between the twisted pairs of conductors, as well as a desired mechanical strain relief to relieve the strain on each conductor, each wire connector terminal and the corresponding connection.

Nevertheless, where a conductor is adjacent to another conductor of an unrelated twisted pair of conductors, electromagnetic coupling occurs between adjacent conductors from different twisted pairs. This coupling introduces an interfering signal into one conductor of a twisted pair of conductors, but not an equal interfering signal into the other conductor of the twisted pair of conductors. Thus, this coupling creates differential noise in the twisted pair of conductors, which can be random because of the random nature of the conductor deformation, and which is a function of how and where the conductors of the cable 8 are terminated. If the strain relief device is used, it is to be appreciated that this random coupling can be reduced with the aid of the strain relief device or it can at least be known and reproducible so that it can be compensated for. The compensation structure of the invention to be described in detail infra, preferably compensates for this differential noise and/or cross-coupling as well as noise or cross-coupling introduced by the shape and arrangement of the leads of the mating connector element.

In addition, referring to FIG. 1, the four twisted pairs of conductors are connected to plug 10 in a standard order and orientation. For example, a first pair of twisted conductors is connected to a middle two wire connector terminals and thus to the middle two contact terminals 21–22. A second pair of twisted conductors is connected to wire connector terminals that straddle the first pair of wire connector terminals and thus, ultimately to contact terminals 20, 23. A third pair of twisted pair of conductors is connected to wire connector terminals on one side of the second pair and thus, ultimately to the contact terminals such as, for example, 24, 25. A fourth pair of twisted conductors is connected to the wire contact terminals on the opposite side of the second pair and thus, ultimately to the contact terminals such as, for example, contact terminals 18, 19. With this standard configuration, the second pair of twisted conductors will encounter crosstalk from the other three pairs of twisted conductors, because the second pair of twisted conductors is connected to contact terminals that are in close proximity to the contact terminals connected to the other three pairs of twisted conductors, and because each conductor of the second pair of twisted conductors will experience different noise and cross-coupling effects.

As discussed above, the conductors of each twisted pair of conductors are driven differentially, wherein the two conductors transmit signals with opposite polarity. When noise from an external source couples to both conductors of a twisted pair of conductors, there is formed a common mode signal that propagates over the twisted pair of conductors. Accordingly, a differential mode amplifier that amplifies the differential signals carrying the data and that attenuates any common-mode signal can be used to eliminate any common-mode noise or crosstalk propagating along the twisted pair of conductors. However, a differential amplifier cannot attenuate any differential crosstalk coupled into just one conductor of a twisted pair of conductors. Accordingly, the compensation structure of one embodiment of the invention preferably also provides counter-coupling that balances out any crosstalk and noise introduced by, for example, the standard format connection between the twisted pairs of conductors of the cable 8 and the plug 10.

As will be discussed in detail infra, the lead frame assembly 46 of one embodiment of the invention includes three layers of leads. However, it is to be appreciated that any number of layer of leads can be used such as, for example, two layers of leads or greater than three layers of leads. It is also to be appreciated that one or more layers of leads can be replaced with a printed circuit board, and that a connector element having at least one layer of leads provided by a printed circuit board is intended to be within the scope of the invention.

In related art RJ-type connectors, it has been known to use two layers of leads. Such related art connectors have been used for frequencies up to 100 MHz and are commonly referred to as Category 5 connectors. However, as data rates go up, there is a need to operate connectors at frequencies greater than 100 MHz. According to one embodiment of the invention, the lead frame assembly preferably includes three layers of leads, which are used to provide part of the compensation structure of the invention. Three layers of leads are used for this embodiment, because it would have been more complex to provide the compensation structure with only two layers of leads, and therefore more difficult to manufacture the lead frame assembly. Nevertheless, it is to be appreciated, as discussed above, that two layers of leads and that more than three layers of leads can also be used, and that a connector element having any number of layers of leads is intended to be within the scope of the invention.

Figure 4C:
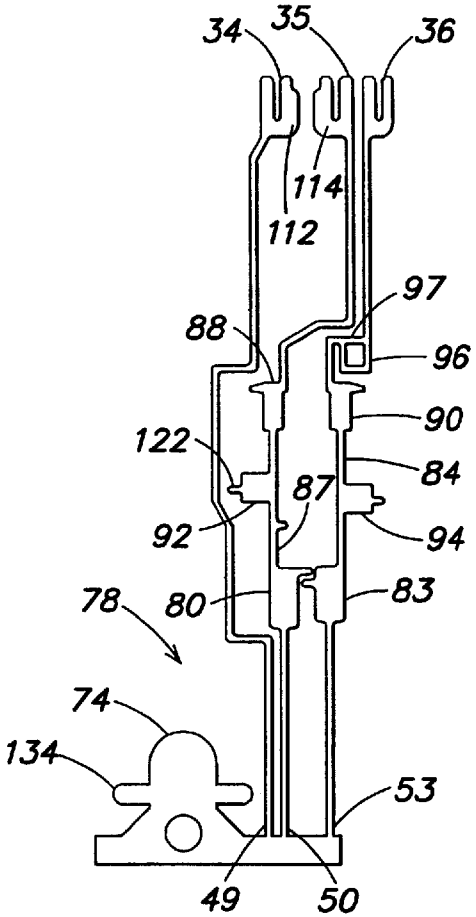
FIG. 4C illustrates an exploded view of a third layer of leads of the lead frame assembly of FIG. 2.
Figure 4B:
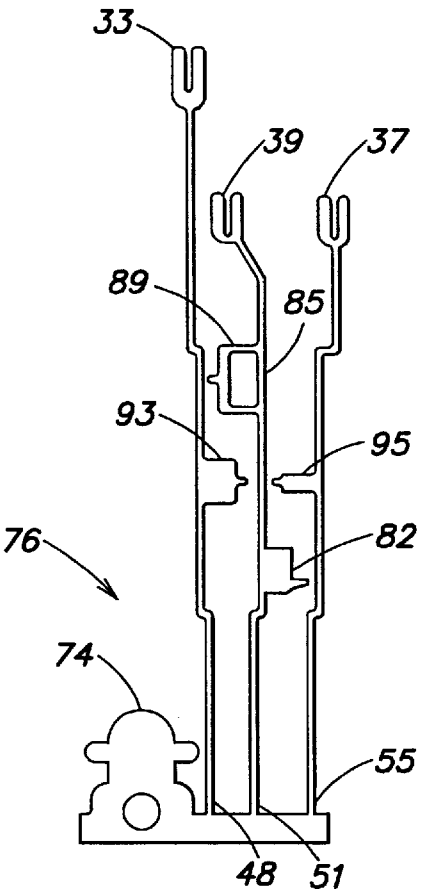
FIG. 4B illustrates an exploded view of a second layer of leads of the lead frame assembly of FIG. 2.
Figure 4A:
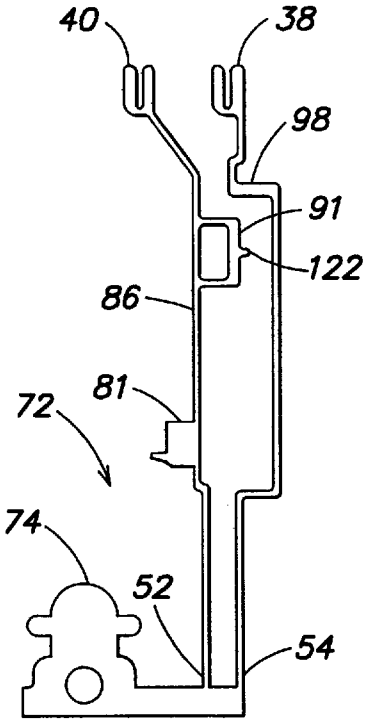
FIG. 4A illustrates an exploded view of a first layer of leads of the lead frame assembly of FIG. 2.

Referring to FIGS. 4A, 4B, 4C, there is illustrated a plan view of the leads 58 which are provided from a strip into a first layer of leads 72 (see FIG. 4A which is an exploded view of the first layer of leads), a second layer of leads 76 (see FIG. 4B which is an exploded view of the second layer of leads), and a third layer of leads 78 (see FIG. 4C which is an exploded view of the third layer of leads). Each lead within each layer of leads is subjected to bending to the desired shapes illustrated in FIGS. 4A–4C so that the first layer of leads 72, the second layer of leads 76 and the third layer of leads 78, together form a complex circuit topology having desired capacitance and inductance properties between them, that together provide the compensation structure of one embodiment of the invention.

Figure 5:
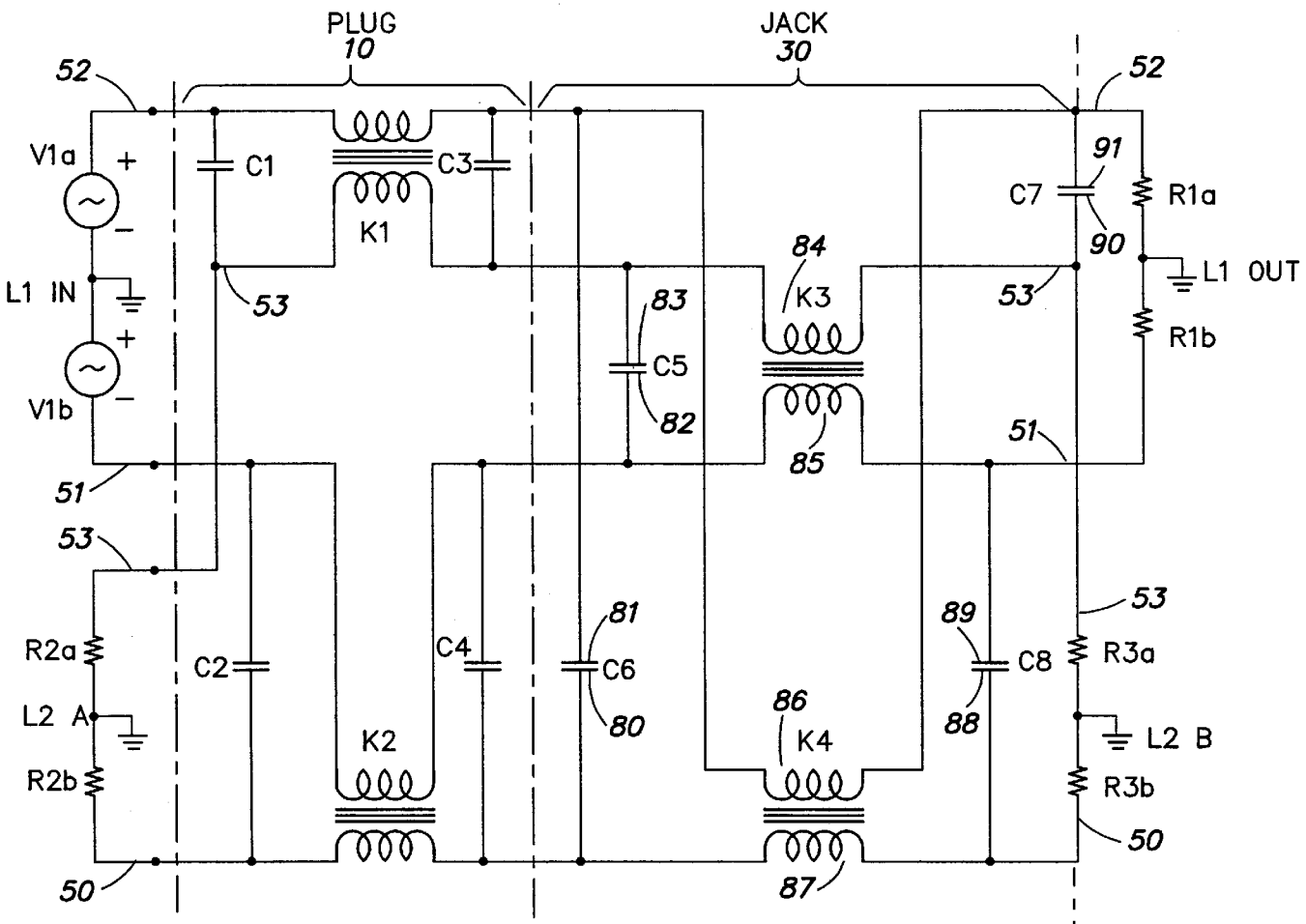
FIG. 5 is a partial schematic diagram of a circuit for simulating a performance of two pairs of leads of a connector element in combination with a mating connector element, according to one embodiment of the invention.

FIG. 5 illustrates a circuit for simulating part of one embodiment of the compensation structure of the invention. It is to be appreciated that FIG. 5 is an equivalent circuit illustrated for the purpose of simulating the effects of the compensating structure of the invention, and is not intended to be an equivalent circuit of the overall compensation structure of this embodiment of the invention. It is to be appreciated that values of compensating components of the compensation structure are selected to compensate for the values of the parasitic components of the plug 10 and jack 30. Taking into account which conductors of the twisted pairs of conductors and which leads of the plurality of leads within the RJ-style plug are adjacent to one another, at least some of the leads of the first layer of leads 72, the second layer of leads 76, and the third layer of leads 78 that make up the overall lead frame assembly 46 (see FIG. 2), are provided with capacitive plates. In addition, at least some of the pairs of leads that are connected to corresponding twisted pairs of conductors are provided with inductive loops between the pairs of leads, to provide a double-Π network between the pairs of leads, that makes up part of the compensation structure of the invention. It is to be appreciated that the double-Π network contributes to the desired properties of reducing both near-end crosstalk (NEXT) and far-end crosstalk (FEXT) of the connector and connector element, when the component values of the circuit are configured as discussed in detail infra.

FIG. 5 includes two pairs of leads, Pair 1 including leads 51, 52, which are the innermost leads, and Pair 2 including the leads 50, 53 which straddle the innermost leads 51, 52 (See FIG. 2). This arrangement of leads is a standard configuration for an RJ-45-type plug, as was discussed above. In FIG. 5, an inductance L and a capacitance C, which are a result, for example, capacitance between the leads of the plug and a loop inductance between leads of the plug 10 and the jack 30 combination, are shown as lumped capacitor components C1, C2, C3, C4, and transformers K1 and K2 between the leads 50, 51, 52 and 53. In particular, capacitive coupling exists between Pairs 1 and 2 through capacitances C1 and C3 and through capacitances C2 and C4. In addition, inductive coupling exists between the pairs of leads Pair 1, Pair 2 by mutual inductance K1 and by mutual inductance K2.

According to this one embodiment of the lead frame assembly, and, in particular, the compensation structure of the invention, in order to obtain a proper phase relationship to compensate for crosstalk introduced by the plug, between leads 52 and 53, which is illustrated in part by capacitances C1 and C3, capacitance C7 is provided between leads 52 and 53, and capacitance C5 is provided between leads 53 and 51. It is to be appreciated that the capacitance value of C5 is larger than the capacitance value of C7, that C5 initially overcompensates for the stray capacitance introduced by the plug and that C7 then compensates for the overcompensation provided by capacitance C5. Similarly, in order to compensate for the crosstalk introduced by the plug between leads 50 and 51, which is illustrated in part by capacitances C2 and C4, capacitance C6 is provided between leads 52 and 50, and capacitance C8 is provided between leads 50 and 51. It is also to be appreciated that the capacitance value of C6 initially overcompensates for the stray capacitance introduced by the plug and the capacitance C8 compensates for the overcompensation introduced by capacitance C6. Similarly, inductive coupling K1 between Pairs 1 and 2 is compensated by introducing mutual loop inductance K4 which is 180° out of phase with the inductive coupling that is being compensated for, and inductive coupling K2 between Pairs 1 and 2 is compensated by introducing mutual loop inductance K3 which is 180° out of phase with the inductive coupling that is being compensated for. Accordingly, the compensation structure of this embodiment of the invention provides a compensating inductance and capacitance to compensate for the capacitance and inductance introduced by the plug and helps to ensure that the coupled signals introduced by the plug are compensated by signals that are 180° out of phase with the signals introduced by the plug.

Referring to FIGS. 4A–4C, leads 50, 51, 52 and 53 are illustrated with capacitive plates that provide the various capacitances discussed above. In particular, referring to lead 50 in FIG. 4C, there is illustrated a first plate 80 of parallel plate capacitance C6, which will form the parallel plate capacitance C6 in the overall lead frame assembly with a second plate 81 in lead 52 (see FIG. 4A). Similarly, lead 51 (see FIG. 4B) is provided with a first plate 82 of parallel plate capacitor C5, which forms parallel plate capacitor C5 in the overall lead frame assembly with second plate 83 of lead 53 (see FIG. 4C). In addition, lead 50 is provided with a first plate 88 (See FIG. 4C) which in combination with a second plate 89 of lead 51 (See FIG. 4B) forms parallel plate capacitance C8 between leads 50 and 51. Similarly, lead 53 is provided with a first plate 90 (See FIG. 4C) which in combination with a second plate 91 of lead 52 (See FIG. 4A) forms parallel plate capacitance C7 between leads 52 and 53.

Figure 6:
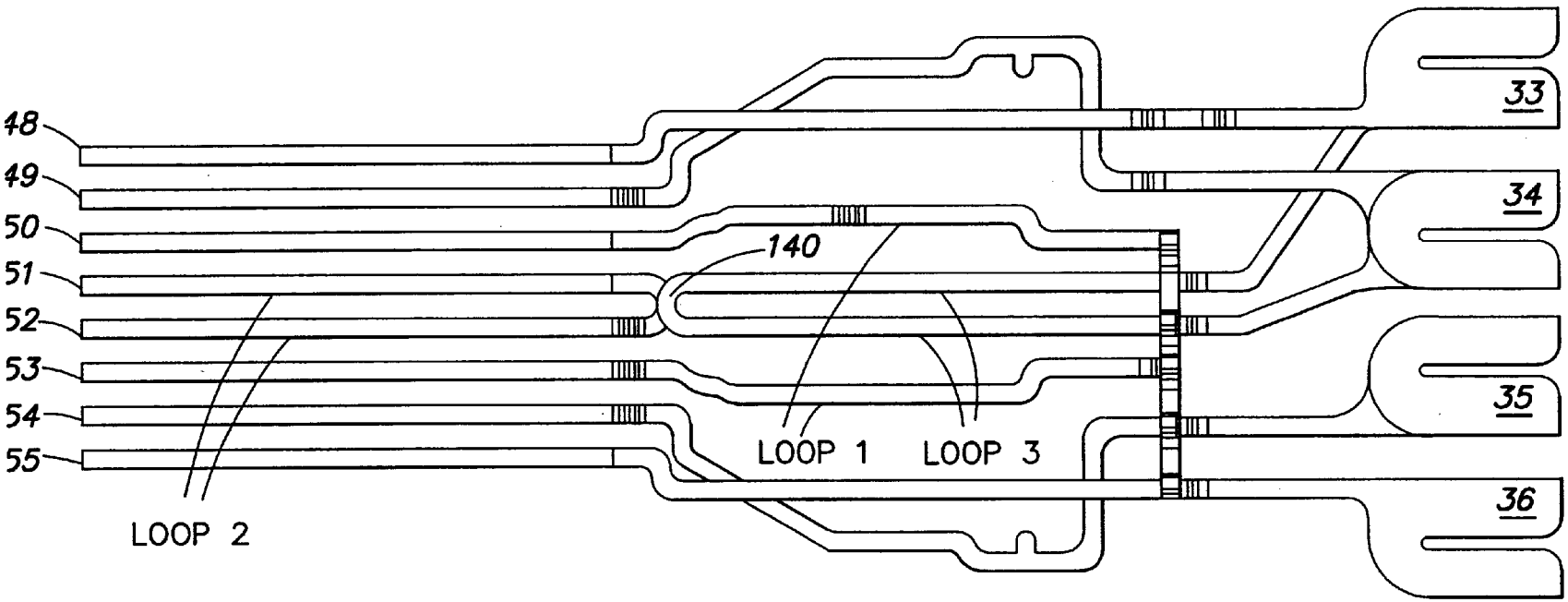
FIG. 6 illustrates a partial top plan view of inductive loops provided by the leads of a connector element in combination with a mating connector element, according to one embodiment of the invention.

Referring to FIG. 6, leads 50, 51, 52 and 53 are illustrated with inductive loops that provide the various inductances discussed above. Referring to leads 50 and 53 which together form the Pair 2 of leads (See FIG. 5), it is to be understood that there is an inductive loop between these leads 50, 53 that begins with the mating plug connector element (not illustrated). The inductive loop between leads 50 and 53 results in the mutual inductance K1, between leads 52 and 53 and the mutual inductance K2, between leads 50 and 51, and thus mutual inductances K1, K2, as illustrated in FIG. 5 between the pairs of leads Pair 1 and Pair 2. The mutual inductances K1 and K2 are compensated by loop inductances K3 and K4 provided by this embodiment of the compensation structure of the invention. As is illustrated in FIG. 6, leads 51 and 52 include a Loop 2 between leads 51 and 52, which begins at the contact terminals and ends at a crossover point 140, at which Loop 3 between leads 51 and 52 begins, and continues to corresponding wire connector terminals 39, 40 (See FIG. 3). As is illustrated in FIG. 6, Loop 3 is provided so that it introduces an opposite phase into the signal that exists in Loop 2. With this arrangement of the leads, there is provided a mutual inductance between Pair 1 and Pair 2 of the leads so as to provide the compensating inductances K3 and K4 as illustrated in FIG. 5. In particular, mutual inductance K3 is provided between leads 51 and 53 and mutual inductance K4 is provided between leads 50 and 52 so as to counterbalance the mutual inductance provided in the plug and jack combination. Accordingly, it is to be appreciated that one means of introducing inductance between the pairs of leads is by loop coupling between the pairs of leads.

It is also to be appreciated that there may also be a secondary means of providing mutual inductance between the pairs of leads. For example, lead 53 includes a length of lead 84 having a certain width that may provide a certain inductance (See FIG. 4C). Similarly, lead 51 has a length of lead 85 with a certain width that may also provide some inductance (See FIG. 4B). Also, lead 52 includes a length of lead 86 having a certain width that may provide a certain inductance (See FIG. 4A), and lead 50 has a length of lead 87 of a certain width that may also provide some inductance (See FIG. 4C). Accordingly, the lengths and the widths of the leads may also provide some inductance and is a secondary means of providing inductance according to one embodiment of the compensation structure of the invention.

Figure 7:
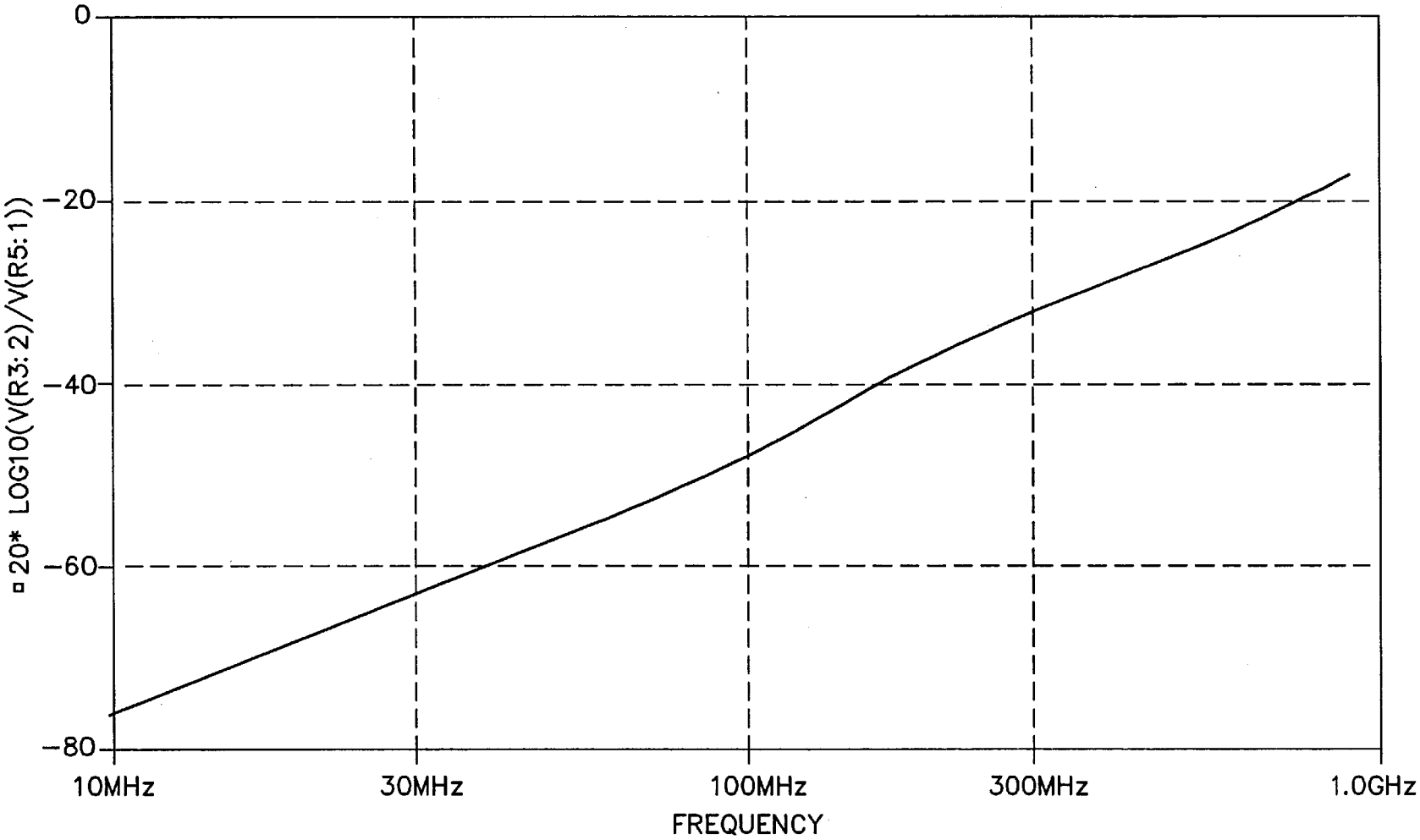
FIG. 7 is a simulated NEXT performance of one embodiment of two pairs of leads of a connector element in combination with a mating connector element, according to one embodiment of the invention.

Referring to FIG. 5, it is to be noted that the inductive and capacitive compensation provided by the lead frame assembly, in addition to offsetting the inductance and capacitance introduced by the plug and jack, and by offsetting this capacitance and inductance, provide the plug and jack with the capability to operate at higher frequencies, such as, up to 300 MHz. Operation at these frequencies is desired for Category 6-type connectors, which the connector system of the invention is intended to be operated at. Referring now to FIG. 7, there is illustrated a simulated performance of the pairs of leads as illustrated in FIG. 5, without a part of the compensation structure of FIG. 5. In particular, FIG. 7 illustrates a simulated performance of the circuit of FIG. 5 without the capacitors C7 and C8 in the compensation structure, and with different values for some of the capacitive and inductive elements, which were optimized without capacitors C7 and C8 included to provide compensation for the stray capacitance and inductance introduced by the plug and jack combination. In particular, FIG. 7 illustrates a near-end crosstalk performance of the Pair 1 and Pair 2 of leads, with a signal injected in Pair 1 at the plug connector element, as is illustrated in FIG. 5, and with a measurement made at Pair 2 at the plug element. An acceptable near-end crosstalk measurement according to standardized specifications for a Category 6-type connector is less than or equal to −44 dB at 300 MHz. Accordingly, referring to FIG. 7, an acceptable frequency range of operation of the mating connector plug and jack is above 100 MHz, but less than 200 MHz. Accordingly, FIG. 7 illustrates that without at least a portion of the compensation structure of this embodiment of the invention, operation of the overall connector is limited to a maximum frequency between 100 and 200 MHz.

Figure 8:
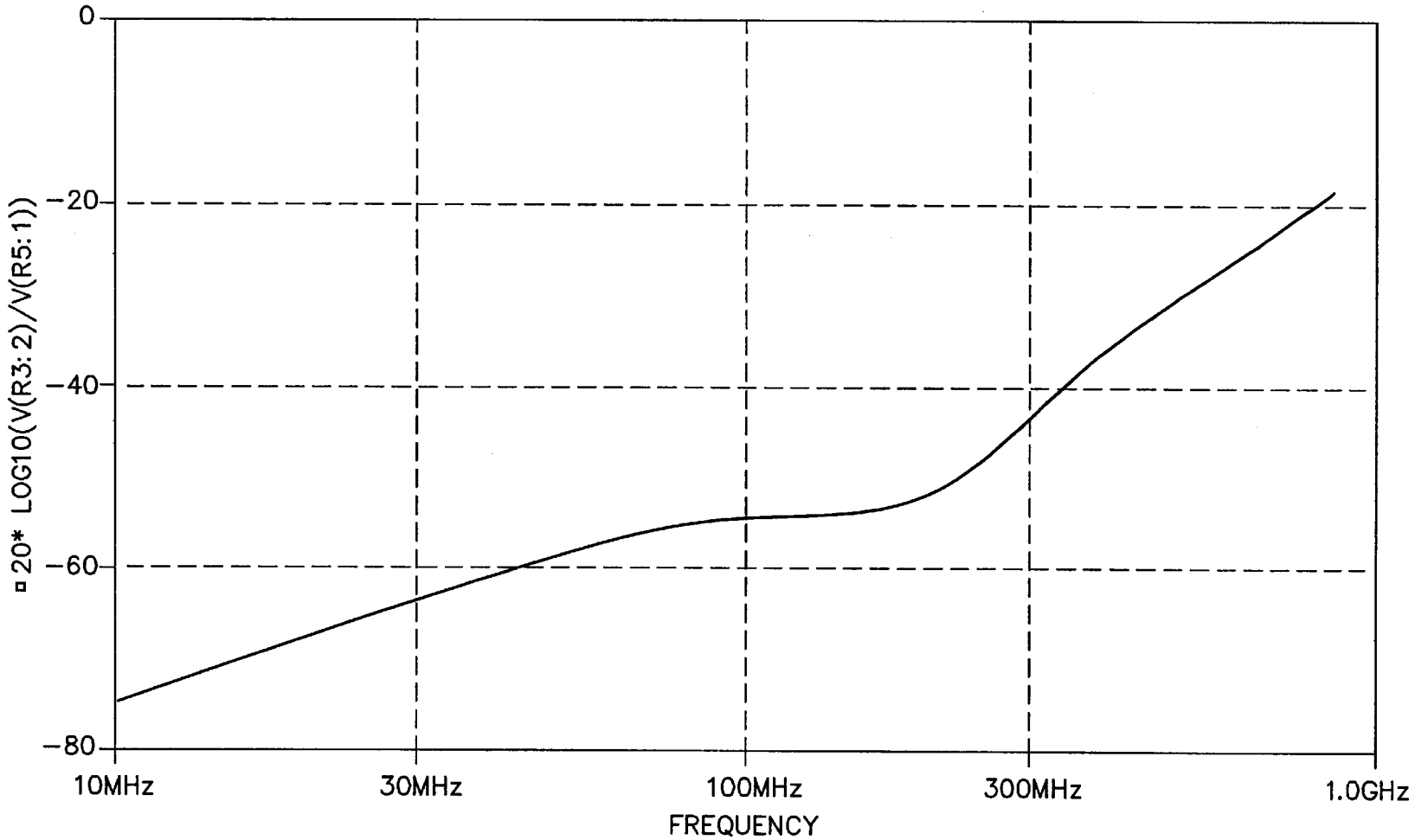
FIG. 8 is a simulated NEXT performance of two pairs of leads of a connector element in combination with a mating connector element, according to one embodiment of the invention, including an embodiment of the compensation structure of the invention.

Referring to FIG. 8, there is illustrated the near-end crosstalk performance of Pairs 1 and 2 as illustrated in FIG. 5, with the embodiment of the compensation structure of the invention as illustrated in FIG. 5. In particular, the simulation is of the NEXT of the compensation structure of FIG. 5 with capacitors C7 and C8 included. For a near-end crosstalk performance of -44 dB at 300 MHz, it can be seen from FIG. 8 that with the compensation structure of the invention, the connector can be operated up to approximately 300 MHz. Accordingly, the compensation structure of the invention provides for higher frequencies of operation for the connector, which satisfy the requirements for Category 6-type connectors. In particular, the addition of capacitors C7 and C8 provide an additional pole to the overall compensation structure, essentially making the compensation structure a third order structure, as opposed to a second order structure without these capacitors.

Referring again to FIGS. 4A–4C, it is to be appreciated that the compensation structure of one embodiment of the invention can also include additional capacitances and/or mutual inductances, such as, an additional capacitance between leads 50 and 48. In particular, lead 50 is provided with a first plate 92 (see FIG. 4C) that in combination with a second plate 93 provided within lead 48 (see FIG. 4B) make up an additional parallel plate capacitance between leads 48 and 50. Similarly, lead 53 can also be provided with a capacitive plate 94 (see FIG. 4C) that in combination with a capacitive plate 95 provided in lead 55 (see FIG. 4B) can make up an additional parallel plate capacitance between leads 53 and 55. It is to be appreciated that although this one embodiment of the invention has been described to include these additional capacitances, that these capacitances are optional, and the compensation structure of this embodiment of the invention is intended to cover such a compensation structure both with and without these additional capacitances.

In addition, referring to FIG. 4C, the compensation structure of this embodiment of the invention can also be provided with an additional smaller capacitance between, for example, leads 53 and 54, which is provided by a small section 97 of lead 53 that is disposed above a small section 98 of lead 54 (see FIG. 4A). The small sections 97 and 98 of corresponding leads 53 and 54 can be provided at a point along the lead frame assembly where leads 48, 49, 50 and 53 are bent up to eventually provide connection between the corresponding contact terminals and the first row of wire contact terminals 33–36 (see FIG. 2). The section 97 of lead 53 and the section 98 of lead 54 together form a small parallel plate capacitance between leads 53 and 54, which also contributes to the overall compensation structure of the lead frame assembly. In particular, this capacitance between leads 53 and 54 is provided near the rear of the jack assembly 30, and in combination with the capacitance provided between leads 53 and 55 by plates 94 and 95 as well as the remainder of the compensation structure, contribute to the overall compensation structure.

This small loop capacitor between leads 53 and 54 is provided as part of the overall compensation structure of the invention so as to improve either one or both of the NEXT and the FEXT of the overall connector assembly. In particular, it was found that while the overall connector assembly prior to providing this capacitance had NEXT and FEXT performance that met desired performance of, for example, Category 6-type connectors, by introducing this additional capacitor, the NEXT and FEXT performance of the connector assembly was improved. Accordingly, this additional capacitor is an additional means for improving one or both of the near-end crosstalk performance of the connector and the far-end crosstalk performance of the connector. It is to be appreciated that although this one embodiment of the compensation structure of the invention has been described to include this additional small capacitance, that this small capacitance is optional, and the compensation structure of this embodiment of the invention is intended to cover a structure both with and without this small capacitance.

It is also to be appreciated that this arrangement of the leads 53 and 54 provides a unique capacitive coupling assembly. In particular, there is a unique capacitance provided by the section 98 of lead 54 that is disposed in a horizontal orientation and the section 97 of the loop 96 that is disposed in a vertical orientation. This unique capacitance between leads 54 and 53 not only contributes to the overall equivalent circuit and electrical performance of the lead frame assembly, but also solves an issue of providing capacitance at a point in the lead frame assembly where capacitance is desired, but where the arrangement of the leads does not allow for a parallel plate capacitor comprised of two horizontally disposed parallel plates, to be used. Accordingly, this structure provides a unique means for providing a capacitance in the lead frame assembly that improves either one or both of the NEXT and FEXT of the overall connector assembly. It is to be appreciated that although this one embodiment of the invention has been described to include this additional means for providing a small capacitance, that this means for providing a small capacitance is not the only way to provide such capacitance, and that the compensation structure of this embodiment of the invention is intended to cover other means for providing such capacitance, such as, parallel plates.

The lead frame assembly of the invention can also be provided with an additional capacitance between, for example, leads 49 and 50. In particular, referring to FIG. 4C and in particular to encircled area 110, wire connector terminals 34, 35 (see also FIG. 2) are provided with enlarged portions 112, 114 of respective wire connector terminals 34, 35. The enlarged portions 112, 114 bring the wire connector terminals 34, 35 closer together than they would be otherwise, and therefore provide a small amount of capacitance between adjacent edges of the wire connector terminals 34 and 35, and thus between leads 49 and 50 of the lead frame assembly. It is to be appreciated that the capacitance provided between leads 49 and 50 by the enlarged portions of the wire connector terminals, also contributes to the overall compensation structure of the lead frame assembly. In addition, it is to be appreciated that by providing this parallel plate capacitance between the enlarged portions of the wire connector terminals, there is provided a capacitive coupling assembly between wire connector terminals 34 and 35 that eliminates the need to, for example, provide a fourth layer of leads so as to introduce this capacitance by, for example, parallel horizontal plates. Therefore, an advantage of this capacitive structure is that the lead frame assembly of this embodiment of the connector element of the invention, can be made with three layers of leads and need not have a fourth layer of leads. Nevertheless, as was discussed above, it is also to be appreciated that the lead frame assembly can be made with only two layers of leads, which will make the two layers of leads more complex, or with greater than three layers of leads, and that such modifications are within the scope of the invention. Accordingly, it is to be appreciated that this capacitive structure of the invention is a means for providing a capacitance between the leads, without the need to complicate the structure by providing an additional layer of leads. In addition, it is to be appreciated that although this one embodiment of the invention has been described to include this additional means for providing a capacitance, that this means for providing this additional capacitance is only one means for providing such capacitance and that other means for providing this capacitance, such as parallel horizontal plates, are intended to be within the scope of the invention.

Referring again to FIGS. 4A–4C, it is to be appreciated that some of the capacitive plates are coupled to the leads by small lengths of lead and are not necessarily connected to the lead along an entire side of the capacitive plate. This mechanical structure is provided so that the capacitive plate can be bent and shaped into its desired arrangement. Nevertheless, it is to be appreciated that this mechanical structure is only one structure, and that other mechanical structures are intended to be within the scope of the invention. It is also to be appreciated that this mechanical structure may also introduce electrical effects, which are compensated for by the overall compensation structure of the invention.

It is also to be appreciated that the capacitive plates can be provided with ears 122 that permit holding the capacitive plates in the desired relationship during a high-pressure, highspeed injection in situ molding process. In particular, the ears allow the capacitive plates to be held in the desired relationship as the fixture is fed to an injection molding machine so that the capacitive plates remain in the desired relationship with respect to one another, and so as to fix the performance of the compensation structure of the invention to a predictable performance. In addition, it is to be appreciated that the plurality of layers of leads 72, 76 and 78 can each be provided with alignment tabs 74 that line up when the plurality of layers of leads are aligned when superimposed, and also include ears 134 (see FIGS. 4A–4C), which can be bent over to secure the plurality of layers together in the desired relationship. It is further to be appreciated that although the ears 122 are provided to keep the capacitive plates in a desired relationship with respect to one another during this injection molding process, they can also contribute to the overall electrical performance of the compensation structure. Accordingly, it is to be appreciated that in one embodiment, the compensation structure has been designed so as to optimize its electrical performance with these ears within the compensation structure. It is to be appreciated that although this one embodiment of the invention has been described to include these additional ears 122, alignment tabs 74, and ears 134 that hold the leads in the fixed relationship during in situ molding, other structures also exist for holding the leads in a fixed relationship during in situ molding, and are intended to be within the scope of this embodiment of the invention.

It is also to be appreciated that although this embodiment of the lead frame assembly has been illustrated as in situ molded, that the lead frame assembly need not be in situ molded. In particular, the lead frame assembly may simply be assembled into various parts of the jack connector assembly as is discussed in detail infra with respect to FIG. 10, without having in situ molded the lead frame assembly. However, a lead frame assembly that is not in situ molded may suffer from unpredictability because the leads may not be necessarily secured in the desired relationship once placed within the housing members of the jack connector assembly. Nevertheless, it is to be appreciated that although the lead frame assembly of this embodiment of the invention is preferably in situ molded, that a lead frame assembly that is not in situ molded and that is simply placed within the housing member parts of the connector assembly, is also intended to be within the scope of the lead frame assembly of the invention.

It is an advantage of the compensation structure and the connector element of the invention that the lead frame can be in situ molded to fix the leads of the lead frame in a desired relationship with respect to one another. In contrast, the related art connectors typically require assembly of the connector element by placing the leads between distinct plastic parts.

However, the performance of such a connector element is not fixed and is much less predictable. Accordingly, it is an advantage of the lead frame assembly of the invention that it can be in situ molded to fix the first, second and third layers of leads with respect to one another so as to obtain a fixed and predictable performance.

Figure 9:
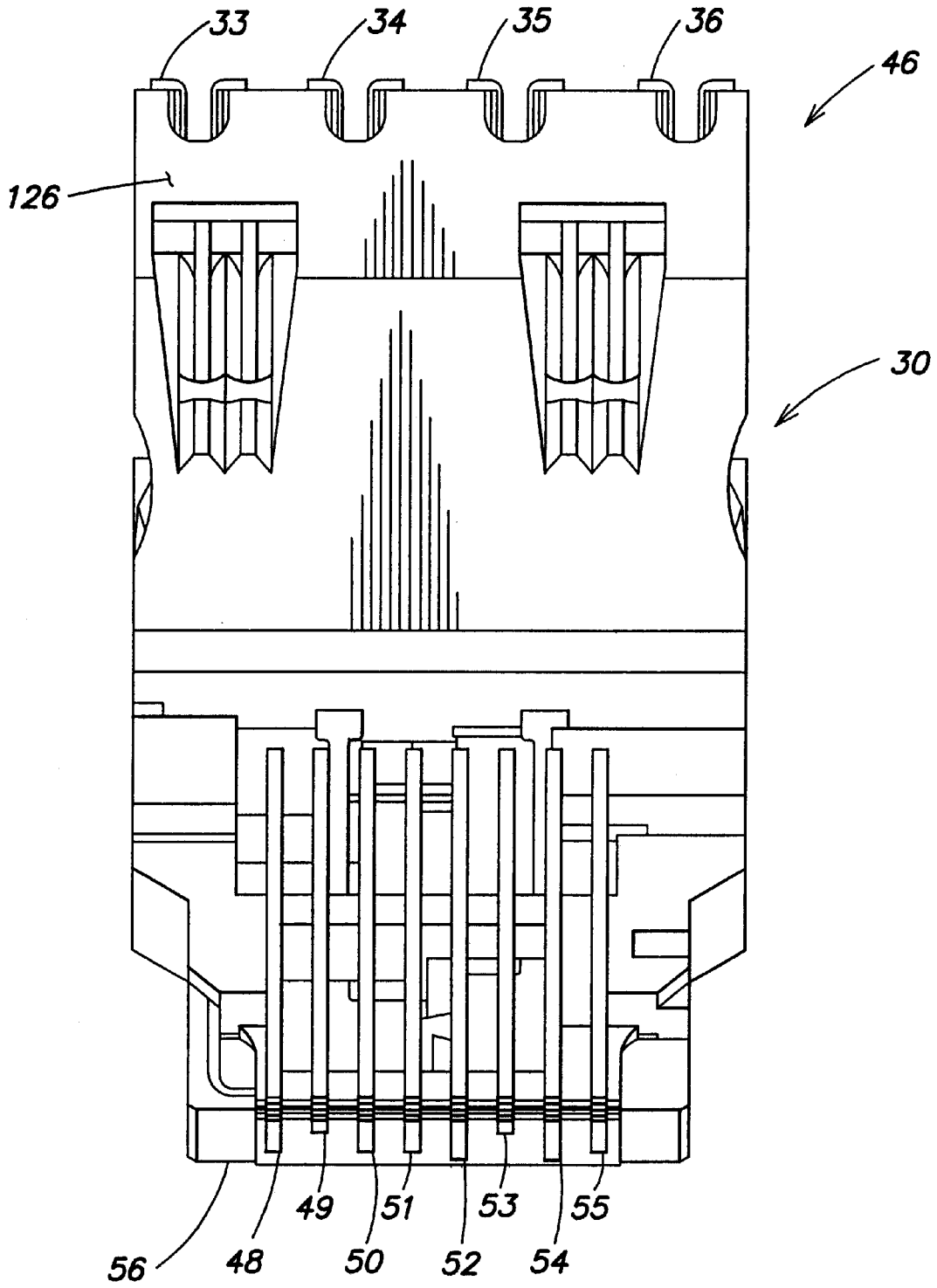
FIG. 9 illustrates a front perspective view of a lead frame assembly according to one embodiment of the invention, after the contact terminals have been bent over in a cantilever spring arrangement.

Referring to FIG. 9, there is illustrated a front perspective view of the lead frame assembly after the in situ molding process, wherein the three layers of leads 72, 76 and 78, the first row 62 of the wire connector terminals and the second row of wire connector terminals (see FIG. 3), are encapsulated within the integrally formed plastic 126. The contact terminals are bent over into the cantilever spring arrangement of the contact terminals 48–55. As is apparent from FIG. 9, some of the lead portions of the lead frame assembly remain exposed after the in situ molding process of the intricately formed plastic 126. Such exposed areas also occur at the underside and the rear side of the lead frame assembly, and are purposedly provided to accommodate the in situ molding process and to allow for the layers of leads to be held in the permanent relationship. It is also to be appreciated that the exposed areas are provided with the purpose of optimizing the dielectric coverage of the leads at any place within the lead frame assembly. In particular, the exposed areas are provided to expose the plates and protrusions of the capacitors so as to provide the plastic between the plates of the capacitor, but not outside of the plates of the capacitor. In particular, the plastic is not provided at the outside of the plates so as to accurately control the spacing between the plates of each capacitor. Nevertheless, it is to be appreciated that although this embodiment of the lead frame assembly is illustrated without the plastic on the outside of the plates of the capacitor, that modifications such as providing the plastic on the outside of the plates of the capacitors are intended to be within the scope of the invention.

Figure 10:
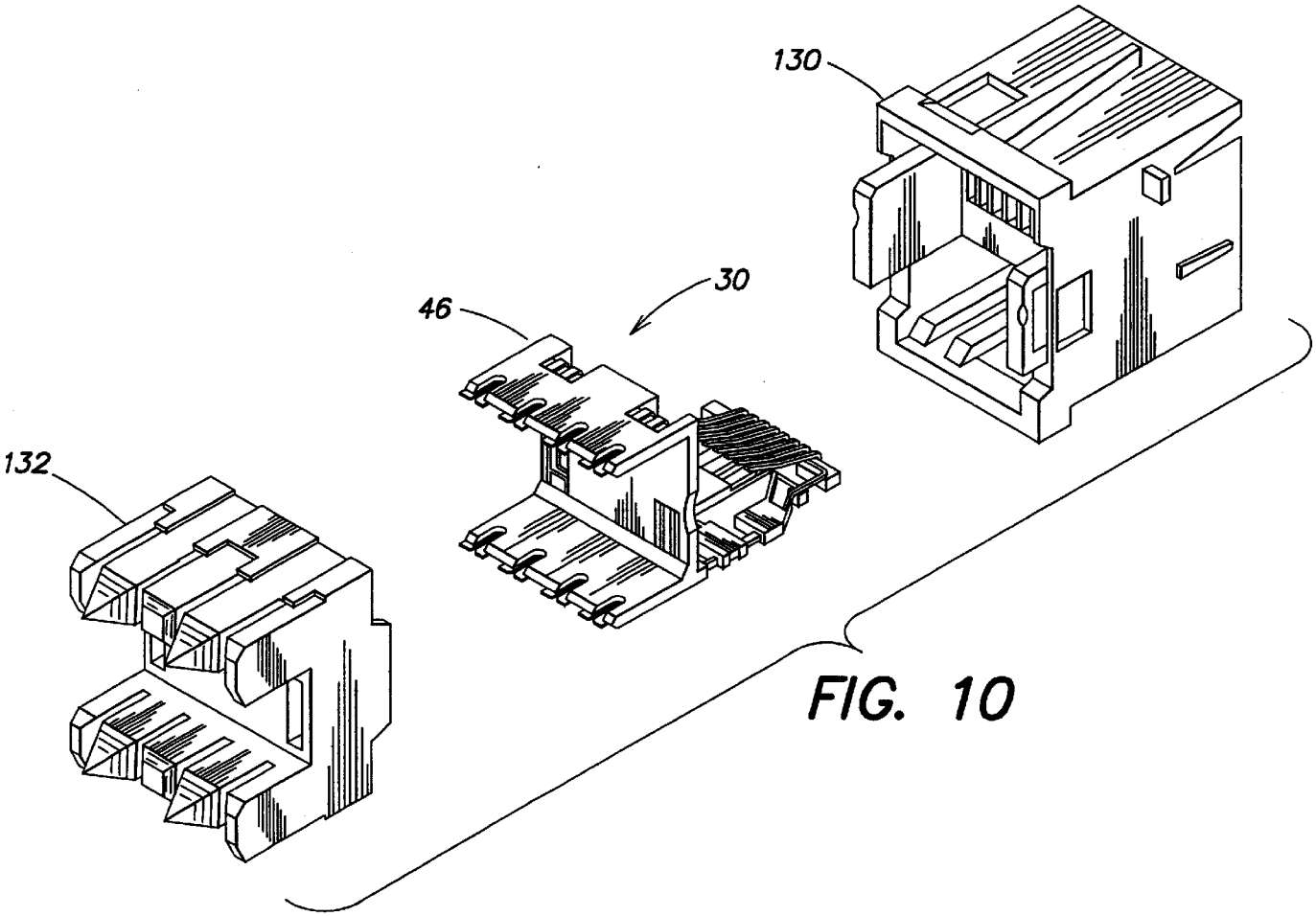
FIG. 10 illustrates a connector element of one embodiment of the invention prior to final assembly, including a front housing member, a rear housing member and the lead frame assembly.

Referring to FIG. 10, there is illustrated from a rear perspective view, various parts of the jack connector assembly 30, prior to assembly. The jack connector assembly 30 of one embodiment of the invention can be assembled by providing a front housing member 130 and a rear housing member 132 and by inserting the lead frame assembly 46 into each of the front housing member and the rear housing member in an appropriate orientation. Thereafter, the front housing member can be secured to the rear housing member by snaplocking the front housing member to the rear housing member as was discussed supra. With this arrangement, there is provided a jack assembly similar to that illustrated, for example, in FIG. 1.

It is to be understood that one advantage of the lead frame assembly of the invention is that even though requirements for the RJ-type connector constrain the leads to be tightly disposed between the contact terminals and the wire connector terminals of the connector, with the lead frame assembly of the invention, the leads are shaped, arranged, and provided with desired capacitive and inductive coupling so as to optimize the performance of the connector element and, in particular, so as to offset coupling and/or noise introduced by the mating plug element. In addition, it is to be appreciated that one embodiment of the lead frame assembly of the invention is in situ molded in plastic, to fix the performance of the connector element and to fix the relationship of the leads with respect to one another. It is also to be appreciated that although the lead frame assembly and the compensation structure of the invention have been illustrated with respect to the jack connector element, that it also can be used in connection with the plug connector element to compensate for any noise and/or coupling introduced by the jack connector element. It is further to be appreciated that each of the plug connector element and jack connector element can be provided with a lead frame assembly and compensation structure of the invention, so as to balance or cancel out the noise and coupling introduced by each respective connector element.

Figure 11:
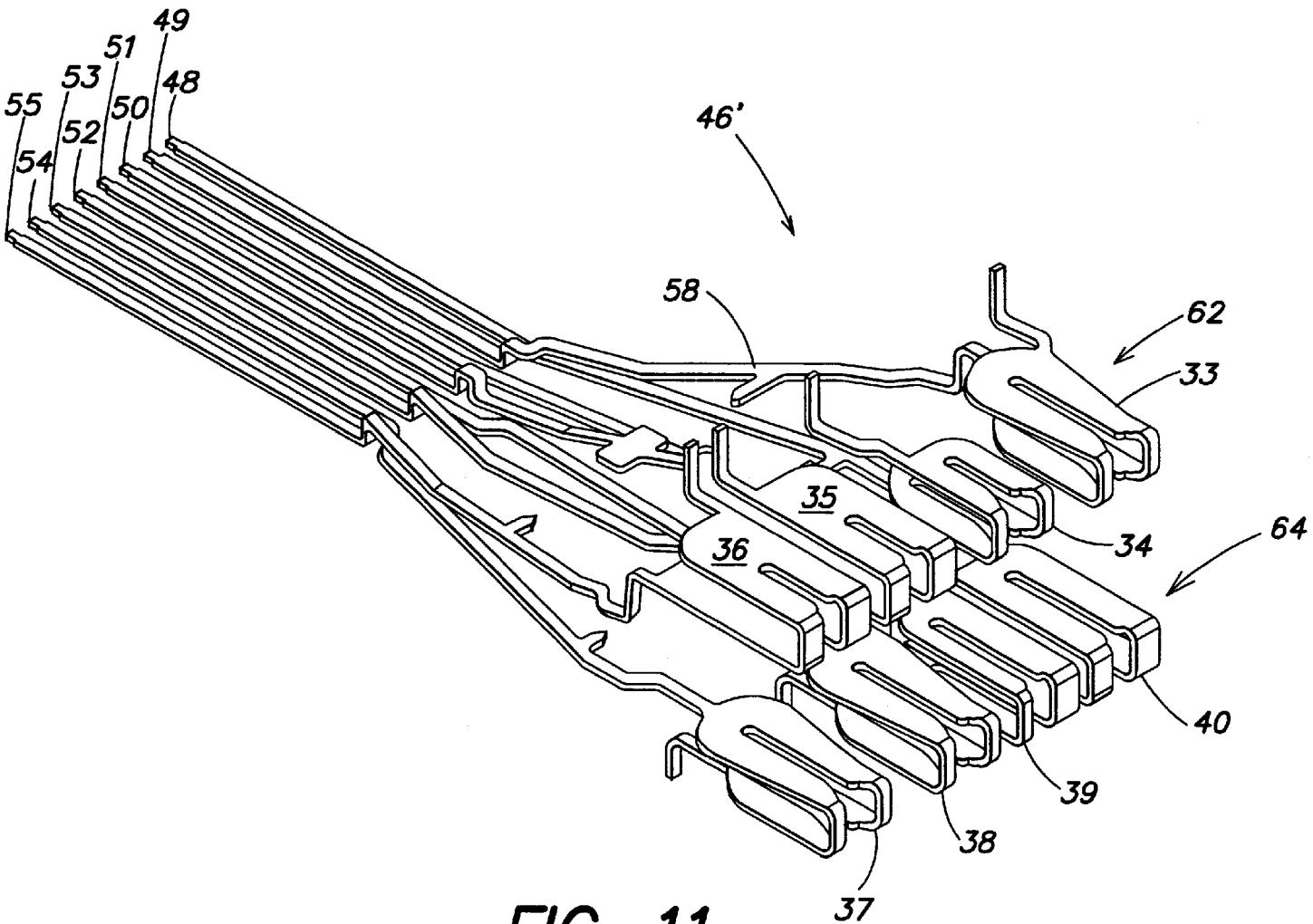
FIG. 11 illustrates a perspective view of a lead frame of a connector element according to another embodiment of the invention.
Figure 12:
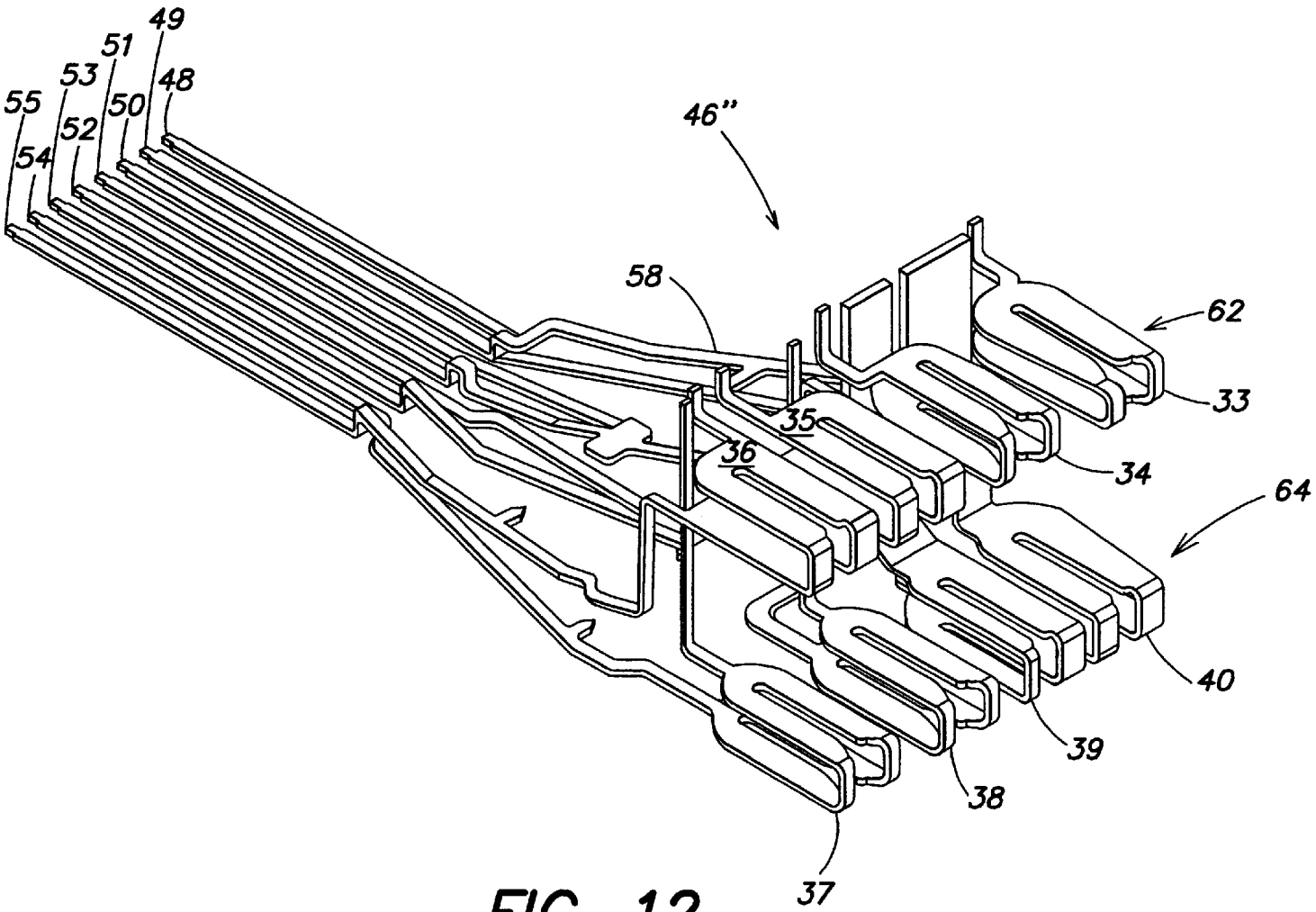
FIG. 12 illustrates a perspective view of a lead frame of a connector element according to another embodiment of the invention.

Referring to FIGS. 11 and 12, there are illustrated alternative embodiments 46' and 46" of the lead frame assembly of the connector element according to other embodiments of the invention. It is to be appreciated that common components of the lead frame assembly and the connector elements have been illustrated with like reference numbers, and that the above description with respect to the reference numbers and the advantages of the lead frame and connector element of the invention, apply to these embodiments also.

Figure 13:
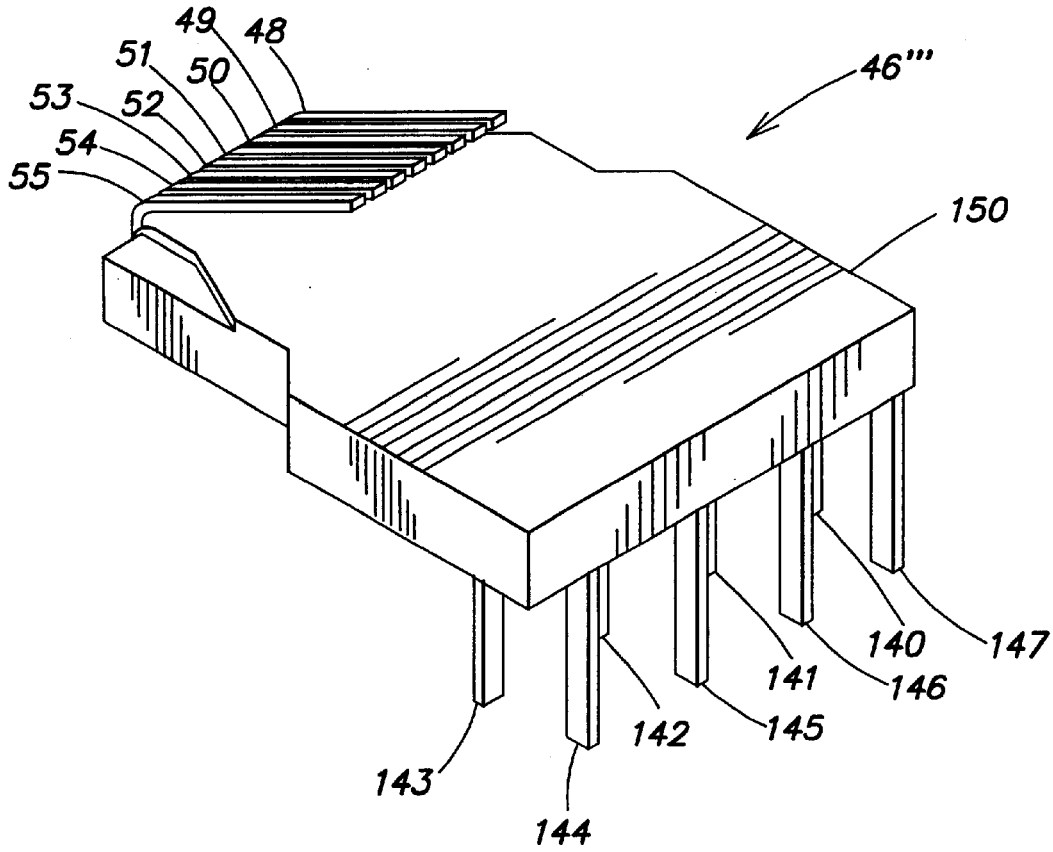
FIG. 13 illustrates a perspective view of a lead frame of a connector element according to still another embodiment of the invention.
Figure 14:
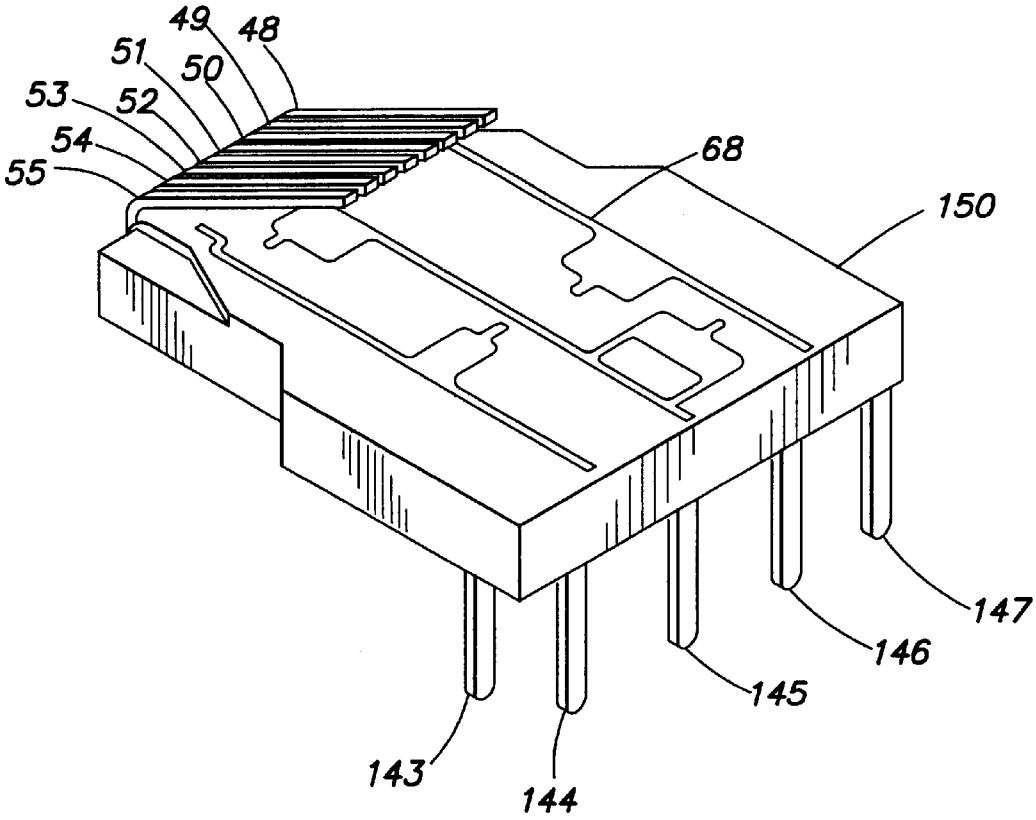
FIG. 14 illustrates a perspective view of a lead frame of a connector element according to FIG. 13.
Figure 15:
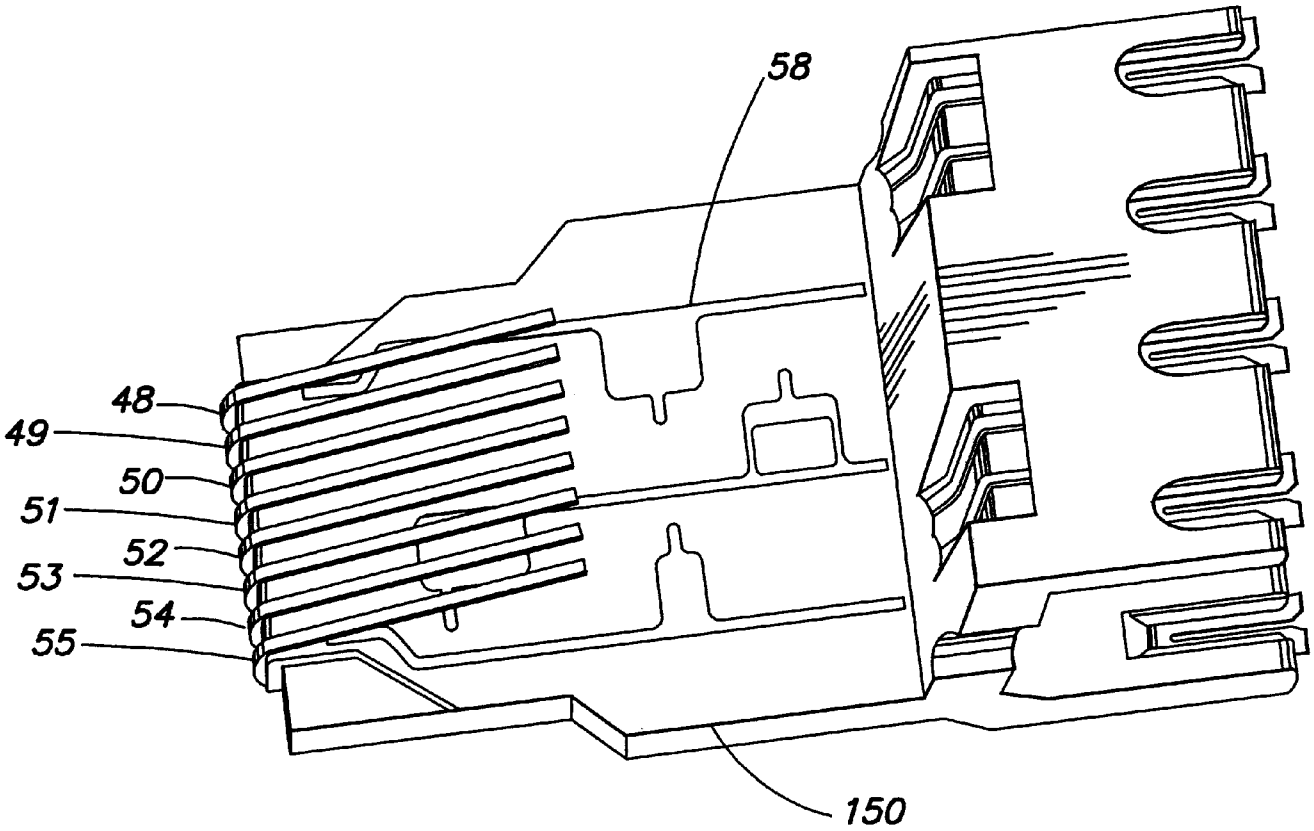
FIG. 15. illustrates a perspective view of a lead frame of a connector element according to still another embodiment of the invention.

Having thus described several embodiments of the invention, various alterations, modifications, and improvements will readily occur to those skilled in the art. For example, referring to FIG. 13, there is illustrated another embodiment of a lead frame assembly 46 for a connector element according to another embodiment of the invention. This embodiment of the lead frame assembly for the connector element may be used to connect between a printed circuit board (PCB) and a cable, and accordingly, the wire connector terminals 33–40 described herein can be replaced with a plurality of connectors 140, 141, 142, 143, 144, 145, 146, 147 to a PCB, Each connector to a PCB can be, for example, a tap to a PCB that is mated and soldered to the PCB. In addition, the plurality of leads 58 described herein, can also be provided on a PCB 150 as illustrated in FIGS. 14 and 15. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A connector element for making a connection between electrical conductors in a communications network, the connector element having a front, a rear and a length between the front and the rear, the connector element comprising:

a plurality of contact terminals arranged at the front of the connector element, the plurality of contact terminals being configured for connection with corresponding terminals of a mating connector element;

a plurality of wire connector terminals arranged at substantially the rear of the connector element; and a plurality of leads, each lead connecting a corresponding wire connector terminal with a corresponding contact terminal, the plurality of leads including three layers of leads that in combination provide a compensation structure that reduces noise or crosstalk introduced by a combination of the connector element and the mating connector element.

2. The connector element as claimed in claim 1, further comprising the mating connector element, and wherein the connector element and the mating connector element together comprise a connector having a transfer function of substantially 1.0.

3. The connector element as claimed in claim 1, wherein the plurality of leads are shaped and arranged to optimize the electrical performance of the combination of the connector element and the mating connector element to operate at frequencies up to and including 300 MHz.

4. The connector element as claimed in claim 1, wherein at least one of the three layers of leads is disposed on a printed circuit board.

5. The connector element as claimed in claim 1, wherein some of the plurality of leads are disposed substantially in a first plane and connect the corresponding wire connector terminals in the first row with the corresponding contact terminals in the first plane, and wherein a remainder of the plurality of leads include a first portion that extends substantially orthogonal to the first plane and a second portion that extends substantially in parallel to the first plane, each of the remainder of the plurality of leads connecting the corresponding wire connector terminal in the second row with the corresponding contact terminal in the first plane.

6. The connector element as claimed in claim 1, wherein the plurality of leads include means for sequentially compensating for noise or crosstalk introduced by the combination of the connector element and the mating connector element.

7. The connector element as claimed in claim 1, wherein at least two of the plurality of wire connector terminals include means for providing a capacitance between the at least two wire connector terminals.

8. The connector element as claimed in claim 1, wherein at least two of the wire connector terminals include enlarged portions of the wire connector terminals, that narrow a space between the at least two wire connector terminals and that provide a parallel plate capacitance between adjacent edges of the at least two wire connector terminals.

9. The connector element as claimed in claim 1, wherein the plurality of leads are held in a fixed relationship by an integrally formed housing enclosing at least a portion of the plurality of leads, so as to fix the electrical performance of the connector element.

10. The connector element as claimed in claim 9, wherein the plurality of leads include means for aligning the at least three layers of leads, and for holding the at least three layers of leads in the fixed relationship, during an in situ molding of the integrally formed housing.

11. The connector element as claimed in claim 9, wherein the at least three layers of leads includes an alignment tab that aligns the at least three layers of leads, the alignment tab including a fixing tab that can be bent over to hold the at least three layers of leads in the fixed relationship during an in situ molding of the integrally formed housing.

12. The connector element as claimed in claim 1, wherein a lead of a pair of leads of the plurality of leads includes in series, a first capacitive plate and a second capacitive plate, wherein the first capacitive plate and the second capacitive plate in combination with corresponding capacitive plates of another pair of leads, form first and second capacitors, wherein the lead in combination with a lead of the other pair of leads form an inductive loop and wherein the first capacitor, the inductive loop, and the second capacitor in combination compensate for noise or crosstalk introduced by the combination of the connector element and the mating connector element.

13. The connector element as claimed in claim 12, wherein each of the capacitive plates has a small protrusion that permits holding of each of the capacitive plates and the corresponding leads in a fixed relationship, so that the plurality of leads can be in situ molded within an integrally formed housing enclosing at least a portion of the plurality of leads, and holding the plurality of leads in the fixed relationship.

14. The connector element as claimed in claim 12, wherein the first capacitor is disposed substantially adjacent the plurality of contact terminals so as to immediately compensate for capacitance introduced by the combination of the connector element and the mating connector element.

15. The connector element as claimed in claim 12, wherein the lead further includes a vertically oriented loop including a bottom portion of the loop that is disposed above a portion of an other lead, and which in combination provide a third capacitor between the lead and the other lead that improves at least one of near-end crosstalk and far-end crosstalk of the connector.

16. The connector element as claimed in claim 12, wherein the lead and an other lead include in combination a means for improving at least one of near-end crosstalk and far-end crosstalk of the connector.

17. A connector element for making a connection between electrical conductors in a communications network, the connector element having a front, a rear and a length along a longitudinal axis between the front and the rear, the connector element comprising:

a plurality of contact terminals arranged at the front of the connector element, the plurality of contact terminals being configured for connection with corresponding terminals of a mating connector element;

a plurality of wire connector terminals arranged at substantially the rear of the connector element;

a plurality of leads disposed along the longitudinal axis, each lead connecting a corresponding wire connector terminal with a corresponding contact terminal, the plurality of leads being held in a fixed relationship so as to fix the electrical performance of the connector element; and an integrally formed housing enclosing at least a portion of the plurality of leads and holding the plurality of leads in the fixed relationship;

wherein the wire connector terminals are disposed horizontally along the longitudinal axis.

18. The connector element as claimed in claim 17, further comprising the mating connector element, and wherein the connector element and the mating connector element together comprise a connector having a transfer function of substantially 1.0.

19. The connector element as claimed in claim 17, wherein the plurality of leads include means for aligning the plurality of leads and for holding the plurality of leads in the fixed relationship during an in situ molding of the integrally formed housing.

20. The connector element as claimed in claim 17, wherein the plurality of leads include an alignment tab that aligns the plurality of leads, the alignment tab including a fixing tab that can be bent over to hold the plurality of leads in the fixed relationship during an in situ molding of the integrally formed housing.

21. The connector element as claimed in claim 17, wherein some of the plurality of leads are disposed substantially in a first plane and connect the corresponding wire connector terminals in the first row with the corresponding contact terminals in the first plane, and wherein a remainder of the plurality of leads include a first portion that extends substantially orthogonal to the first plane and a second portion that extends substantially in parallel to the first plane, each of the remainder of the plurality of leads connecting the corresponding wire connector terminal in the second row with the corresponding contact terminal in the first plane.

22. The connector element as claimed in claim 17, wherein the plurality of leads include means for sequentially compensating for noise or crosstalk introduced by a combination of the connector element and the mating connector element.

23. The connector element as claimed in claim 17, wherein at least two of the plurality of wire connector terminals include means for providing a capacitance between the at least two wire connector terminals.

24. The connector element as claimed in claim 17, wherein at least two of the wire connector terminals include enlarged portions of the wire connector terminals, that narrow a space between the at least two wire connector terminals and that provide a parallel plate capacitance between adjacent edges of the at least two wire connector terminals.

25. The connector element as claimed in claim 17, wherein the plurality of leads include a plurality of layers of leads that in combination provide a compensation structure that reduces noise or crosstalk introduced by a combination of the connector element and the mating connector element.

26. The connector element as claimed in claim 25, wherein at least one of the plurality of layers of leads is disposed on a printed circuit board.

27. The connector element as claimed in claim 17, wherein a lead of a pair of leads of the plurality of leads includes in series, a first capacitive plate and a second capacitive plate, wherein the first capacitive plate and the second capacitive plate in combination with corresponding capacitive plates of an other pair of leads, form first and second capacitors, wherein the lead in combination with a lead of the other pair of leads form an inductive loop, and wherein the first capacitor, the inductive loop, and the second capacitor in combination compensate for noise or crosstalk introduced by a combination of the connector element and the mating connector element.

28. The connector element as claimed in claim 27, wherein each of the capacitive plates has a small protrusion that permits holding of each of the capacitive plates and the corresponding leads in a fixed relationship, so that the plurality of leads can be in situ molded within an integrally formed housing enclosing at least a portion of the plurality of leads, and holding the plurality of leads in the fixed relationship.

29. The connector element as claimed in claim 27, wherein the first capacitor is disposed substantially adjacent the plurality of contact terminals so as to immediately compensate for capacitance introduced by a combination of the connector element and the mating connector element.

30. The connector element as claimed in claim 25, wherein the lead further includes a vertically oriented loop including a bottom portion of the loop that is disposed above a portion of an other lead, and which in combination provide a third capacitor between the lead and the other lead that improves at least one of near-end crosstalk and far-end crosstalk of the connector.

31. The connector element as claimed in claim 27, wherein the lead and an other lead include in combination a means for improving at least one of near-end crosstalk and far-end crosstalk of the connector.

32. A connector element for making a connection between electrical conductors in a communications network, the connector element having a front, a rear and a length between the front and the rear, the connector element comprising:

a plurality of contact terminals arranged at the front of the connector element, the plurality of contact terminals being configured for connection with corresponding terminals of a mating connector element;

a plurality of wire connector terminals arranged at substantially the rear of the connector element; and a plurality of leads, each lead connecting a corresponding wire connector terminal with a corresponding contact terminal, the plurality of leads including means for sequentially compensating for noise or crosstalk introduced by a combination of the connector element and the mating connector element.

33. The connector element as claimed in claim 32, further comprising the mating connector element, and wherein the connector element and the mating connector element together comprise a connector having a transfer function of substantially 1.0.

34. The connector element as claimed in claim 32, wherein some of the plurality of leads are disposed substantially in a first plane and connect corresponding wire connector terminals in the first row with the corresponding contact terminals in the first plane, and wherein a remainder of the plurality of leads include a first portion that extends substantially orthogonal to the first plane and a second portion that extends substantially in parallel to the first plane, each of the remainder of the plurality of leads connecting the corresponding wire connector terminal in the second row with the corresponding contact terminal in the first plane.

35. The connector element as claimed in claim 32, wherein at least two of the plurality of wire connector terminals include means for providing a capacitance between the at least two wire connector terminals.

36. The connector element as claimed in claim 32, wherein at least two of the wire connector terminals include enlarged portions of the wire connector terminals, that narrow a space between the at least two wire connector terminals and that provide a parallel plate capacitance between adjacent edges of the at least two wire connector terminals.

37. The connector element as claimed in claim 32, wherein the plurality of leads include a plurality of layers of leads that in combination provide a compensation structure that reduces any noise or crosstalk introduced by the combination of the connector element and the mating connector element.

38. The connector element as claimed in claim 34, wherein at least one of the plurality of layers of leads is disposed on a printed circuit board.

39. The connector element as claimed in claim 32, wherein the plurality of leads are held in a fixed relationship by an integrally formed housing enclosing at least a portion of the plurality of leads, so as to fix the electrical performance of the connector element.

40. The connector element as claimed in claim 39, wherein the plurality of leads include means for aligning the plurality of leads and for holding the plurality of leads in the fixed relationship during an in situ molding of the integrally formed housing.

41. The connector element as claimed in claim 39, wherein the plurality of leads include an alignment tab that aligns the plurality of leads, the alignment tab including a fixing tab that can be bent over to hold the plurality of leads in the fixed relationship during an in situ molding of the integrally formed housing.

42. The connector element as claimed in claim 32, wherein the means for sequentially compensating includes a lead of a pair of leads having in series, a first capacitive plate and a second capacitive plate, wherein the first capacitive plate and the second capacitive plate in combination with corresponding capacitive plates of an other pair of leads, form first and second capacitors, wherein the lead in combination with a lead of the other pair of leads form an inductive loop, and wherein the first capacitor, the inductive loop, and the second capacitor in combination compensate for noise or crosstalk introduced by the combination of the connector element and the mating connector element.

43. The connector element as claimed in claim 42, wherein each of the capacitive plates has a small protrusion that permits holding of each of the capacitive plates and the corresponding leads in a fixed relationship, so that the plurality of leads can be in situ molded within an integrally formed housing enclosing at least a portion of the plurality of leads, and holding the plurality of leads in the fixed relationship.

44. The connector element as claimed in claim 42, wherein the first capacitor is disposed substantially adjacent the plurality of contact terminals so as to immediately compensate for capacitance introduced by the combination of the connector element and the mating connector element.

45. The connector element as claimed in claim 42, wherein the lead further includes a vertically oriented loop including a bottom portion of the loop that is disposed above a portion of an other lead, and which in combination provide a third capacitor between the lead and the other lead that improves at least one of near-end crosstalk and far-end crosstalk of the connector.

46. The connector element as claimed in claim 42, wherein the lead and an other lead include in combination a means for improving at least one of near-end crosstalk and far-end crosstalk of the connector.

47. A connector element for making a connection between electrical conductors in a communications network, the connector element having a front, a rear and a length between the front and the rear, the connector element comprising:

a plurality of contact terminals arranged at the front of the connector element, the plurality of contact terminals being configured for connection with corresponding terminals of a mating connector element;

a plurality of wire connector terminals arranged at substantially the rear of the connector element; and a plurality of leads, each lead connecting a corresponding wire connector terminal with a corresponding contact terminal, a lead of a pair of leads of the plurality of leads includes in series, a first capacitive plate and a second capacitive plate, wherein the first capacitive plate and the second capacitive plate in combination with corresponding capacitive plates of another pair of leads, form first and second capacitors, wherein the lead in combination with a lead of the other pair of leads form an inductive loop, and wherein the first capacitor, the inductive loop and the second capacitor in combination compensate for noise or crosstalk introduced by a combination of the connector element and the mating connector element.

48. The connector element as claimed in claim 47, further comprising the mating connector element, and wherein the connector element and the mating connector element together comprise a connector having a transfer function of substantially 1.0.

49. The connector element as claimed in claim 47, wherein the plurality of leads include a plurality of layers of leads that in combination provide a compensation structure that reduces noise or crosstalk introduced by the combination of the connector element and the mating connector element.

50. The connector element as claimed in claim 47, wherein at least one of the plurality of layers of leads is disposed on a printed circuit board.

51. The connector element as claimed in claim 47, wherein some of the plurality of leads are disposed substantially in a first plane and connect the corresponding wire connector terminals in the first row with the corresponding contact terminals in the first plane, and wherein a remainder of the plurality of leads include a first portion that extends substantially orthogonal to the first plane and a second portion that extends substantially in parallel to the first plane, each of the remainder of the plurality of leads connecting the corresponding wire connector terminal in the second row with the corresponding contact terminal in the first plane.

52. The connector element as claimed in claim 47, wherein each of the capacitive plates has a small protrusion that permits holding of each of the capacitive plates and the corresponding leads in a fixed relationship, so that the plurality of leads can be in situ molded within an integrally formed housing enclosing at least a portion of the plurality of leads, and holding the plurality of leads in the fixed relationship.

53. The connector element as claimed in claim 47, wherein the first capacitor is disposed substantially adjacent the contact terminals so as to immediately compensate for capacitance introduced by the combination of the connector element and the mating connector element.

54. The connector element as claimed in claim 47, wherein the lead further includes a vertically oriented loop including a bottom portion of the loop that is disposed above a portion of an other lead, and which in combination provide a third capacitor between the lead and the other lead that improves at least one of near-end crosstalk and, far-end crosstalk of the connector.

55. The connector element as claimed in claim 47, wherein the lead and an other lead include in combination a means for improving at least one of near-end crosstalk and far-end crosstalk of the connector.

56. The connector element as claimed in claim 47, wherein at least two of the plurality of wire connector terminals include means for providing a capacitance between the at least two wire connector terminals.

57. The connector element as claimed in claim 47, wherein at least two of the wire connector terminals include enlarged portions of the wire connector terminals, that narrow a space between the at least two wire connector terminals and that provide a parallel plate capacitance between adjacent edges of the at least two wire connector terminals.

58. The connector element as claimed in claim 47, wherein the plurality of leads are held in a fixed relationship by an integrally formed housing enclosing at least a portion of the plurality of leads, so as to fix the electrical performance of the connector element.

59. The connector element as claimed in claim 51, wherein the plurality of leads include means for aligning the plurality of leads and for holding the plurality of leads in the fixed relationship during an in situ molding of the integrally formed housing.

60. The connector element as claimed in claim 58, wherein the plurality of leads include an alignment tab that aligns the plurality of leads, the alignment tab including a fixing tab that can be bent over to hold the plurality of leads in the fixed relationship during an in situ molding of the integrally formed housing.

61. A connector element for making a connection between electrical conductors in a communications network, the connector element having a front, a rear and a length between the front and the rear, the connector element comprising:

a plurality of contact terminals arranged at the front of the connector element, the plurality of contact terminals being configured for connection with corresponding terminals of a mating connector element;

a plurality of wire connector terminals arranged at substantially the rear of the connector element;

a plurality of leads, each lead connecting a corresponding wire connector terminal with a corresponding contact terminal, the plurality of leads including a plurality of layers of leads that in combination provide a compensation structure that reduces noise or crosstalk introduced by a combination of the connector element and the mating connector element; and wherein at least two of the plurality of wire connector terminals include means for providing a capacitance between the at least two wire connector terminals.

62. The connector element as claimed in claim 61, further comprising the mating connector element, and wherein the connector element and the mating connector element together comprise a connector having a transfer function of substantially 1.0.

63. The connector element as claimed in claim 61, wherein the plurality of layers of leads include at least three layers of leads.

64. The connector element as claimed in claim 61, wherein at least one of the plurality of layers of leads is disposed on a printed circuit board.

65. The connector element as claimed in claim 61, wherein some of the plurality of leads are disposed substantially in a first plane and connect the corresponding wire connector terminals in the first row with the corresponding contact terminals in the first plane, and wherein a remainder of the plurality of leads include a first portion that extends substantially orthogonal to the first plane and a second portion that extends substantially in parallel to the first plane, each of the remainder of the plurality of leads connecting the corresponding wire connector terminal in the second row with the corresponding contact terminal in the first plane.

66. The connector element as claimed in claim 61, wherein the plurality of leads include means for sequentially compensating for noise or crosstalk introduced by the combination of the connector element and the mating connector element.

67. The connector element as claimed in claim 61, wherein the means for providing the capacitance between the at least two of the wire connector terminals includes enlarged areas that narrow a space between the at least two wire connector terminals and that provide a parallel plate capacitance between adjacent edges of the at least two wire connector terminals.

68. The connector element as claimed in claim 61, wherein the plurality of leads are held in a fixed relationship by an integrally formed housing enclosing at least a portion of the plurality of leads, so as to fix the electrical performance of the connector element.

69. The connector element as claimed in claim 68, wherein the plurality of leads include means for aligning the plurality of layers of leads and for holding the plurality of layers of leads in the fixed relationship during an in situ molding of the integrally formed housing.

70. The connector element as claimed in claim 68, wherein each of the plurality of layers of leads includes an alignment tab that aligns the plurality of layers of leads, the alignment tab including a fixing tab that can be bent over to hold the plurality of layers of leads in the fixed relationship during an in situ molding of the integrally formed housing.

71. The connector element as claimed in claim 61, wherein a lead of a pair of leads of the plurality of leads includes in series, a first capacitive plate and a second capacitive plate, wherein the first capacitive plate and the second capacitive plate in combination with corresponding capacitive plates of an other pair of leads, form first and second capacitors, wherein the lead in combination with a lead of the other pair of leads forms an inductive loop, and wherein the first capacitor, the inductive loop, and the second capacitor in combination compensate for noise or crosstalk introduced by the combination of the connector element and the mating connector element.

72. The connector element as claimed in claim 71, wherein each of the capacitive plates has a small protrusion that permits holding of each of the capacitive plates and the corresponding leads in a fixed relationship, so that the plurality of leads can be in situ molded within an integrally formed housing enclosing at least a portion of the plurality of leads, and holding the plurality of leads in the fixed relationship.

73. The connector element as claimed in claim 71, wherein the first capacitor is disposed substantially adjacent the plurality of contact terminals so as to immediately compensate for capacitance introduced by the combination of the connector element and the mating connector element.

74. The connector element as claimed in claim 71, wherein the lead further includes a vertically oriented loop including a bottom portion of the loop that is disposed above a portion of an other lead, and which in combination provide a third capacitor between the lead and the other lead that improves at least one of near-end crosstalk and far-end crosstalk of the connector.

75. The connector element as claimed in claim 71, wherein the lead and an other lead include in combination a means for improving at least one of near-end crosstalk and far-end crosstalk of the connector.

76. A connector element for making a connection between electrical conductors in a communications network, the connector element having a front, a rear and a length between the front and the rear, the connector element comprising:

a plurality of contact terminals arranged at the front of the connector element, the plurality of contact terminals being configured for connection with corresponding terminals of a mating connector element;

a plurality of wire connector terminals arranged at substantially the rear of the connector element;

a plurality of leads, each lead connecting a corresponding wire connector terminal with a corresponding contact terminal, the plurality of leads including a plurality of layers of leads that in combination provide a compensation structure that reduces noise or crosstalk introduced by a combination of the connector element and the mating connector element; and wherein at least two of the wire connector terminals include enlarged portions of the wire connector terminals that narrow a spacing between the at least two wire connector terminals and that provide a parallel plate capacitance between adjacent edges of the at least two wire connector terminals.

77. The connector element as claimed in claim 76, further comprising the mating connector element, and wherein the connector element and the mating connector element together comprise a connector having a transfer function of substantially 1.0.

78. The connector element as claimed in claim 76, wherein the plurality of layers of leads include at least three layers of leads.

79. The connector element as claimed in claim 76, wherein at least one of the plurality of layers of leads is disposed on a printed circuit board.

80. The connector element as claimed in claim 76, wherein some of the plurality of leads are disposed substantially in a first plane and connect the corresponding wire connector terminals in the first row with the corresponding contact terminals in the first plane, and wherein a remainder of the plurality of leads include a first portion that extends substantially orthogonal to the first plane and a second portion that extends substantially in parallel to the first plane, each of the remainder of the plurality of leads connecting the corresponding wire connector terminal in the second row with the corresponding contact terminal in the first plane.

81. The connector element as claimed in claim 76, wherein the plurality of leads include means for sequentially compensating for noise or crosstalk introduced by the combination of the connector element and the mating connector element.

82. The connector element as claimed in claim 76, wherein the plurality of leads are held in a fixed relationship by an integrally formed housing enclosing at least a portion of the plurality of leads, so as to fix the electrical performance of the connector element.

83. The connector element as claimed in claim 82, wherein the plurality of leads include means for aligning the plurality of layers of leads and for holding the plurality of layers of leads in the fixed relationship during an in situ molding of the integrally formed housing.

84. The connector element as claimed in claim 82, wherein each of the plurality of layers of leads include an alignment tab that aligns the plurality of layers of leads, the alignment tab including a fixing tab that can be bent over to hold the plurality of layers of leads together in the fixed relationship during an in situ molding of the integrally formed housing.

85. The connector element as claimed in claim 76, wherein a lead of a pair of leads of the plurality of leads includes in series, a first capacitive plate and a second capacitive plate, wherein the first capacitive plate and the second capacitive plate in combination with corresponding capacitive plates of an other pair of leads, form first and second capacitors, wherein the lead in combination with a lead of the other pair of leads forms an inductive loop, and wherein the first capacitor, the inductive loop, and the second capacitor in combination compensate for noise or crosstalk introduced by combination of the connector element and the mating connector element.

86. The connector element as claimed in claim 85, wherein each of the capacitive plates has a small protrusion that permits holding of each of the capacitive plates and the corresponding leads in a fixed relationship, so that the plurality of leads can be in situ molded within an integrally formed housing enclosing at least a portion of the plurality of leads, and holding the plurality of leads in the fixed relationship.

87. The connector element as claimed in claim 85, wherein the first capacitor is disposed substantially adjacent the plurality of contact terminals so as to immediately compensate for capacitance introduced by the combination of the connector element and the mating connector element.

88. The connector element as claimed in claim 85, wherein the lead further includes a vertically oriented loop including a bottom portion of the loop that is disposed above a portion of an other lead, and which in combination provide a third capacitor between the lead and the other lead that improves at least one of near-end crosstalk and far-end crosstalk of the connector.

89. The connector element as claimed in claim 85, wherein the lead and an other lead include in combination a means for improving at least one of near-end crosstalk and far-end crosstalk of the connector.

90. A connector element for making a connection between electrical conductors in a communications network, the connector element having a front, a rear and a length between the front and the rear, the connector element comprising:

a plurality of contact terminals arranged at the front of the connector element, the plurality of contact terminals being configured for connection with corresponding terminals of a mating connector element;

a plurality of printed circuit board connector terminals arranged at substantially the rear of the connector element;

a plurality of leads, each lead connecting a corresponding printed circuit board connector terminal with a corresponding contact terminal, the plurality of leads being held in a fixed relationship so as to fix the electrical performance of the connector element; and an integrally formed housing enclosing at least a portion of the plurality of leads and holding the plurality of leads in the fixed relationship.

91. The connector element as claimed in claim 90, further comprising the mating connector element, and wherein the connector element and the mating connector element together comprise a connector having a transfer function of substantially 1.0.

92. The connector element as claimed in claim 90, wherein the plurality of leads include a plurality of layers of leads that in combination provide a compensation structure that reduces noise or crosstalk introduced by a combination of the connector element and the mating connector element.

93. The connector element as claimed in claim 90, wherein the plurality of leads include means for aligning the plurality of leads and for holding the plurality of leads in the fixed relationship during an in situ molding of the integrally for housing.

94. The connector element as claimed in claim 90, wherein the plurality of leads include an alignment tab that aligns the plurality of leads, the alignment tab including a fixing tab that can be bent over to hold the plurality of leads in the fixed relationship during an in situ molding of the integrally formed housing.

95. The connector element as claimed in claim 90, wherein the plurality of leads include means for sequentially compensating for noise or crosstalk introduced by a combination of the connector element and the mating connector element.

96. The connector element as claimed in claim 92, wherein at least one of the plurality of layers of leads is disposed on a printed circuit board.

97. The connector element as claimed in claim 96, wherein the plurality of layers of leads and the plurality of printed circuit board connector terminals are on a same printed circuit board.

98. The connector element as claimed in claim 90, wherein a lead of a pair of leads of the plurality of leads includes in series, a first capacitive plate and a second capacitive plate, wherein the first capacitive plate and the second capacitive plate in combination with corresponding capacitive plates of an other pair of leads, form first and second capacitors, wherein the lead in combination with a lead of the other pair of leads form an inductive loop, and wherein the first capacitor, the inductive loop, and the second capacitor in combination compensate for noise or crosstalk introduced by a combination of the connector element and the mating connector element.

99. The connector element as claimed in claim 98, wherein each of the capacitive plates has a small protrusion that permits holding of each of the capacitive plates and the corresponding leads in a fixed relationship, so that the plurality of leads can be in situ molded within an integrally formed housing enclosing at least a portion of the plurality of leads, and holding the plurality of leads in the fixed relationship.

100. The connector element as claimed in claim 98, wherein the first capacitor is disposed substantially adjacent the plurality of contact terminals so as to immediately compensate for capacitance introduced by the mating connector element.

* * * * *